US011177601B2

(12) United States Patent
Kitaoka et al.

(10) Patent No.: US 11,177,601 B2
(45) Date of Patent: Nov. 16, 2021

(54) TERMINAL HAVING A CONDUCTOR AND A SPRING

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Kenichi Kitaoka, Yokkaichi (JP); Junichi Mukuno, Yokkaichi (JP)

(73) Assignees: AUTONETWORKS TECHNOLOGIES, LTD., Mie (JP); SUMITOMO WIRING SYSTEMS, LIMITED, Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/959,472

(22) PCT Filed: Nov. 7, 2018

(86) PCT No.: PCT/JP2018/041353
§ 371 (c)(1),
(2) Date: Jul. 1, 2020

(87) PCT Pub. No.: WO2019/142459
PCT Pub. Date: Jul. 25, 2019

(65) Prior Publication Data

US 2021/0075139 A1 Mar. 11, 2021

(30) Foreign Application Priority Data

Jan. 16, 2018 (JP) ..... JP2018-004683

(51) Int. Cl.
*H01R 13/02* (2006.01)
*H01R 13/187* (2006.01)
*H01R 13/506* (2006.01)

(52) U.S. Cl.
CPC ..... *H01R 13/187* (2013.01); *H01R 13/506* (2013.01)

(58) Field of Classification Search
CPC .... H01R 13/187; H01R 13/506; H01R 13/02; H01R 13/15; H01R 13/00; H01R 13/10
(Continued)

(56) References Cited

U.S. PATENT DOCUMENTS 741,052 A * 10/1903 Mahon ..... H01R 13/28 200/51.1
2,326,327 A * 8/1943 Brewer ..... H01R 13/28 439/291
(Continued)

FOREIGN PATENT DOCUMENTS

EP 1 089 387 A2 4/2001
GB 2 315 929 A 2/1998

OTHER PUBLICATIONS

Feb. 5, 2019 Search Report issued in International Patent Application No. PCT/JP2018/041353.

*Primary Examiner* — Harshad C Patel
(74) *Attorney, Agent, or Firm* — Oliff PLC

(57) ABSTRACT

A terminal, including: a conductor made of a metal material, the conductor being in a form of a plate and being provided with a contact point to be conductively connected to a mating terminal; and a spring formed to be thinner than the conductor and resiliently deformable and provided with a mount mounted on the conductor and a cantilever cantilevered from the mount and relatively displaceable with respect to the conductor, the mating terminal being resiliently held in contact with the contact point by being pressed
(Continued)

by the cantilever, a tip of the mating terminal being disposed between the mount and the contact point.

5 Claims, 29 Drawing Sheets

(58) Field of Classification Search
USPC ..... 439/729
See application file for complete search history.

(56) References Cited

U.S. PATENT DOCUMENTS

| | | | | | |
|---|---|---|---|---|---|
| 3,208,030 | A * | 9/1965 | Evans | H01R 13/28 | 439/290 |
| 4,552,425 | A * | 11/1985 | Billman | H01R 13/28 | 439/295 |
| 4,963,102 | A | 10/1990 | Gettig et al. | | |
| 4,992,062 | A * | 2/1991 | Nakayama | H01H 85/2035 | 439/620.26 |
| 5,035,639 | A * | 7/1991 | Kilpatrick | H01R 13/28 | 439/290 |
| 6,910,925 | B2 * | 6/2005 | Endo | H01R 13/187 | 439/856 |
| 8,998,657 | B1 * | 4/2015 | Von Eckroth | H01R 13/193 | 439/857 |
| 9,601,855 | B2 | 3/2017 | Kashiwada et al. | | |
| 10,686,271 | B2 * | 6/2020 | Schaeuble | H01R 13/113 | |
| 10,938,125 | B2 * | 3/2021 | Yamada | H01R 4/029 | |
| 2002/0115311 | A1 | 8/2002 | Furutani | | |
| 2011/0250798 | A1 * | 10/2011 | Mukuno | H01R 13/187 | 439/660 |

* cited by examiner

TERMINAL HAVING A CONDUCTOR AND A SPRING

BACKGROUND

A technique disclosed by this specification relates to a terminal.

Conventionally, a female terminal described in Japanese Unexamined Patent Publication No. 2015-219977 is known as a female terminal to be connected to a male terminal. This female terminal includes a rectangular tube portion in the form of a tube constituted by a plurality of peripheral walls and a resilient piece extending in a front-rear direction inside the rectangular tube portion. The male terminal is conductively connected to the female terminal by being sandwiched between the resilient piece and the peripheral wall facing the resilient piece. This female terminal is formed by press-working one metal plate material. A material having both a spring property required to properly ensure a contact pressure with the male terminal and conductivity required for electrical connection to the male terminal is used as the metal plate material.

SUMMARY

However, the metal plate material having both the spring property and conductivity tends to be expensive and a material cost reduction is difficult. Further, since rigidity increases with an increase in the plate thickness of the metal plate material as a current becomes larger, it becomes difficult to form the rectangular tube portion itself and the entire rectangular tube portion becomes quite large by the enlargement of each peripheral wall constituting the rectangular tube portion. In addition, if the rigidity of the metal plate material becomes excessively high, the spring property required for the resilient piece is lost.

A terminal according to the technique disclosed by this specification includes a conductor made of a metal material, the conductor being in a form of a plate and being provided with a contact point to be conductively connected to a mating terminal, and a spring formed to be thinner than the conductor and resiliently deformable and provided with a mount mounted on the conductor and a cantilever cantilevered from the mount and relatively displaceable with respect to the conductor, the mating terminal being resiliently held in contact with the contact point by being pressed by the cantilever.

According to this configuration, the spring only has to have a spring property as a required performance and needs not have conductivity. Thus, the spring can be made of an inexpensive metal material and material cost can be reduced. Further, even if a plate thickness of the conductor increases as a current becomes larger, bending and the like are not necessary in forming the conductor. Thus, the formation of the conductor does not become difficult. Furthermore, since the conductor is not in the form of a rectangular tube, but in the form of a plate, the conductor is only enlarged by an increase of the plate thickness. In addition, since the spring and the conductor are separate, even if the plate thickness of the conductor increases, that does not affect the spring property of the spring.

The terminal disclosed by this specification may be configured as follows.

The mount may include a pair of side mounts for sandwiching both side edge parts of the conductor and a coupler coupling the pair of side mounts.

According to this configuration, the spring can be mounted on the conductor by sandwiching the both side edge parts of the conductor by the pair of side mounts.

The cantilever may be cantilevered forward from a front edge of the coupler and bent to approach the conductor after being separated from the conductor.

According to this configuration, the spring property of the cantilever can be maintained satisfactory as compared to the case where the cantilever is in the form of a flat plate.

A box may be provided which accommodates the spring inside.

According to this configuration, the spring can be protected by the box.

The spring may be integrally formed to the box.

According to this configuration, it is sufficient to mount the box on the conductor and it is not necessary to separately mount the spring on the conductor.

According to the terminal disclosed by this specification, it is possible to deal with a larger current without enlargement while reducing material cost.

DETAILED DESCRIPTION OF EMBODIMENTS

First Embodiment

Figure 1:
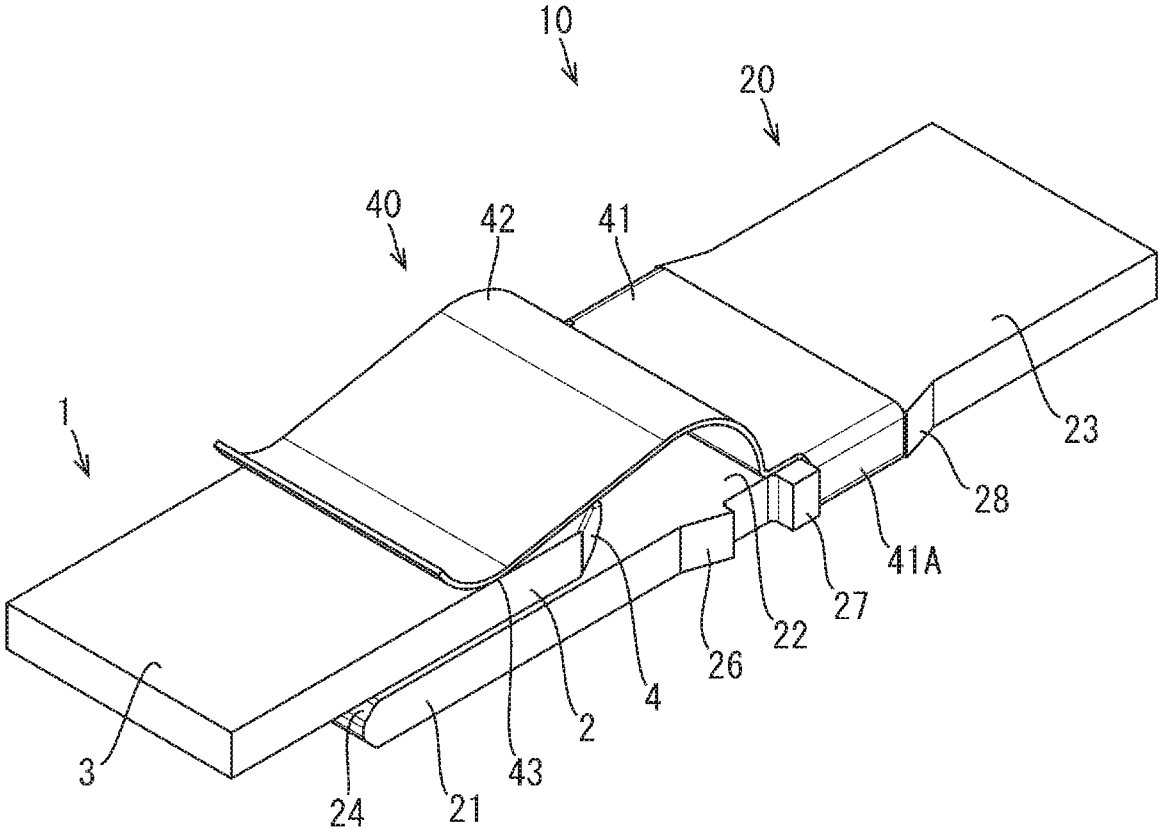
FIG. 1 is a perspective view showing a state where a terminal in a first embodiment and a mating terminal are connected.
Figure 2:
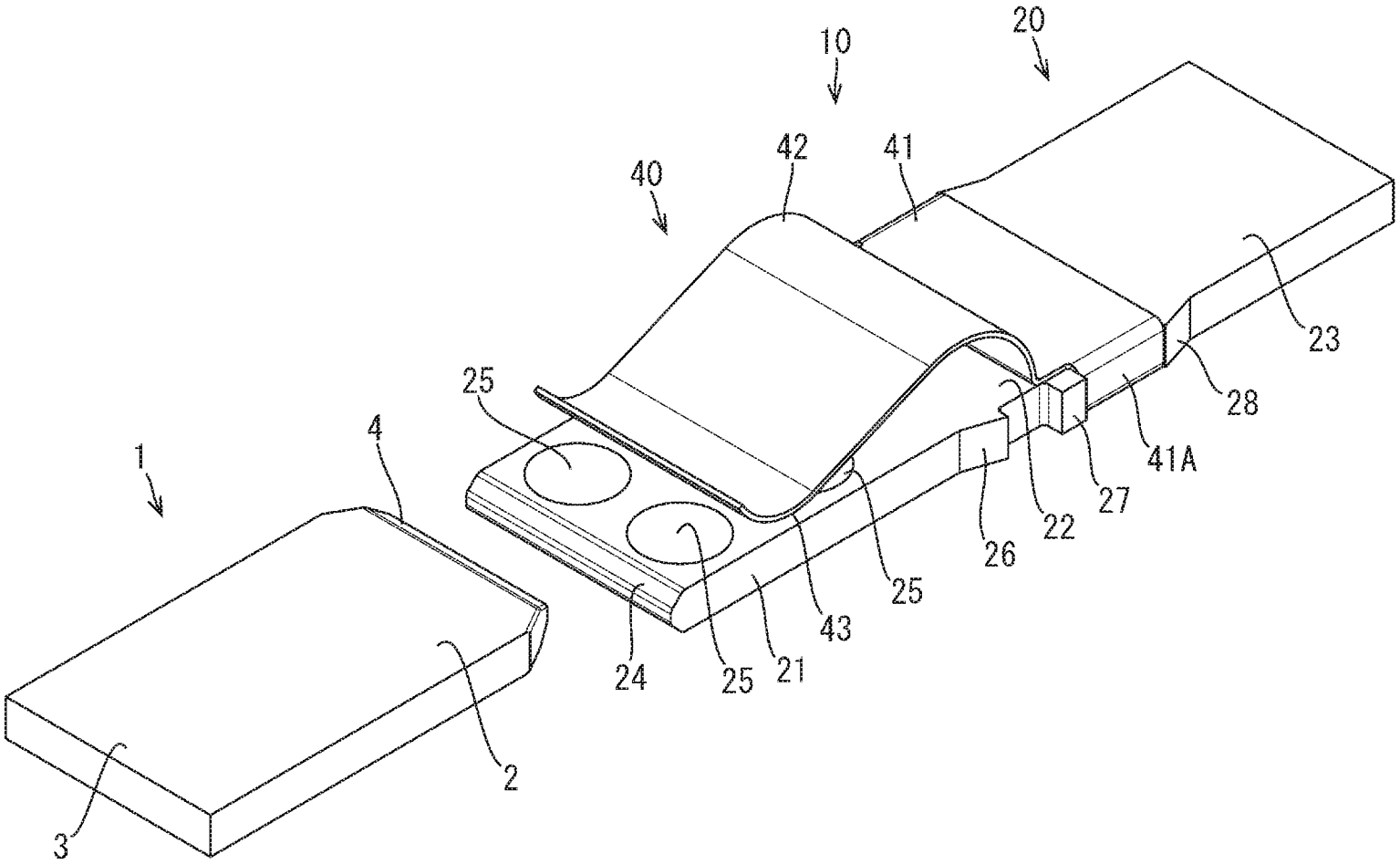
FIG. 2 is a perspective view showing a state before the terminal and the mating terminal are connected.

A first embodiment is described with reference to FIGS. 1 to 8. A terminal 10 of this embodiment is connectable to a mating terminal 1 in the form of a flat tab as shown in FIG. 1. The mating terminal 1 is made of a conductive metal material and in the form of a flat plate. As shown in FIG. 2, the mating terminal 1 includes a terminal connecting portion 2 to be connected to the terminal 10 and a wire connecting portion 3 to be connected to an unillustrated wire. A tapered guiding portion 4 is provided on the tip of the terminal connecting portion 2.

As shown in FIG. 2, the terminal 10 includes a conductive portion 20 (conductor) in the form of a flat plate long in a front-rear direction and a spring portion 40 (spring) separate from the conductive portion 20. The conductive portion 20 is made of a conductive metal material (e.g. copper or copper alloy) and in the form of a flat plate. The spring portion 40 is made of a non-conductive material or a metal material having a low conductivity (e.g. stainless steel), and formed to be thinner than the conductive portion 20 and resiliently deformable.

The conductive portion 20 includes a terminal connecting portion 21 which is connected to the mating terminal 1, a mounted portion 22 on which the spring portion 40 and the like are mounted, and a wire connecting portion 23 to which an unillustrated wire is connected in this order from front.

A tapered guiding portion 24 is provided on the front end of the terminal connecting portion 21. Further, a plurality of contact point portions 25 (contact points) are provided on the upper surface of the terminal connecting portion 21. The contact point portion 25 is an upward projecting projection having an arcuate cross-section. In this embodiment, a total of four contact point portions 25 are provided in two rows in a lateral direction and in two rows in a front-rear direction on the terminal connecting portion 21. Heights of the respective contact point portions 25 from the upper surface of the conductive portion 20 are equal.

Figure 7:
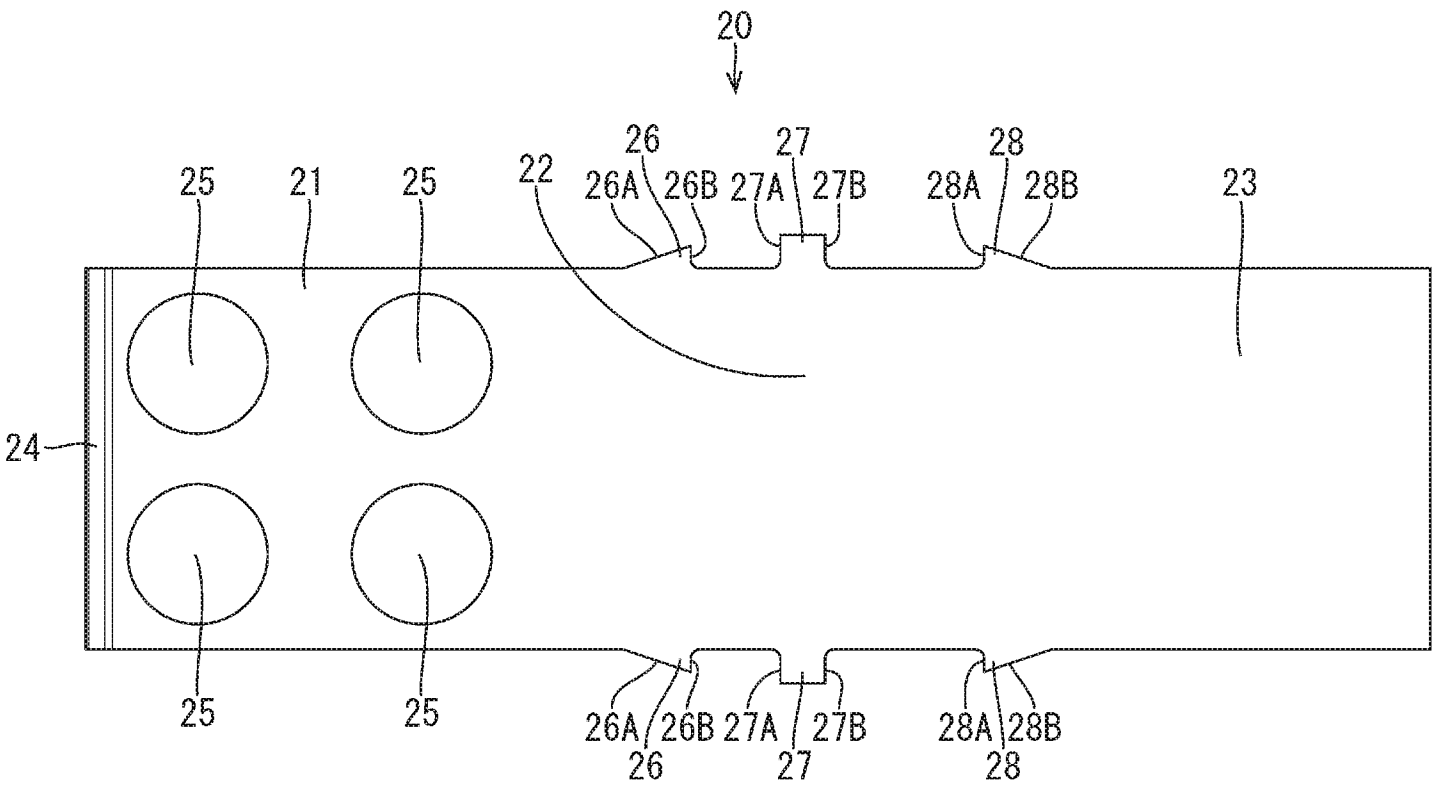
FIG. 7 is a plan view of the conductive portion.

As shown in FIG. 7, the mounted portion 22 includes a plurality of projecting pieces 26, 27 and 28. A pair of left and right first projecting pieces 26 located at a foremost position have front surfaces 26A approaching both side edges of the mounted portion 22 toward the front and rear surfaces 26B orthogonal to the both side edges of the mounted portion 22. A pair of left and right second projecting pieces 27 located at a second position from the front have front surfaces 27A and rear surfaces 27B orthogonal to the both side edges of the mounted portion 22. A pair of left and right third projecting pieces 28 located at a third position from the front have front surfaces 28A orthogonal to the both side edges of the mounted portion 22 and rear surfaces 28B approaching the both side edges of the mounted portion 22 toward the rear.

Figure 6:
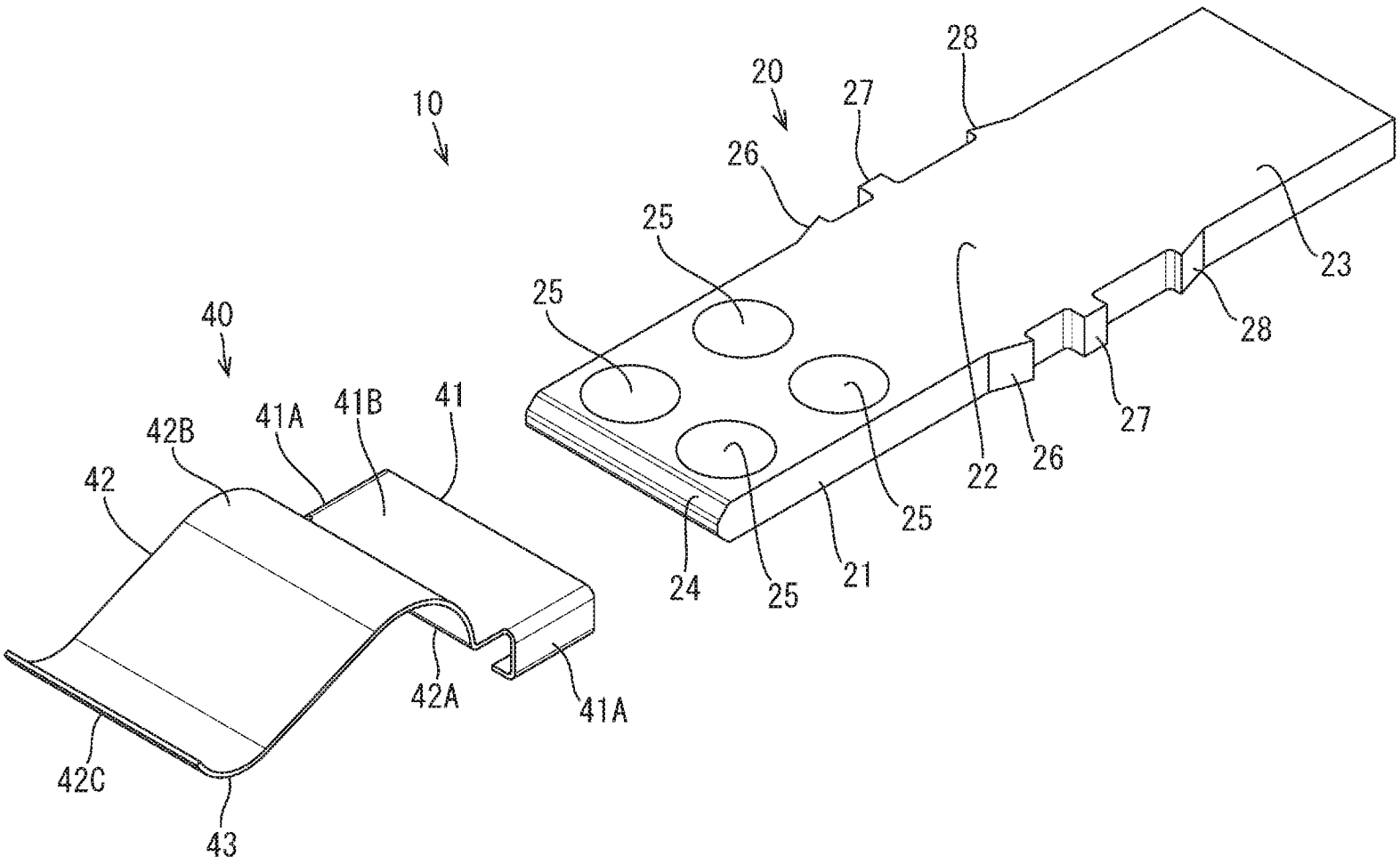
FIG. 6 is a perspective view showing a state before a spring portion is mounted on a conductive portion.

As shown in FIG. 6, the spring portion 40 includes a mounting portion 41 (mount) to be mounted on the mounted portion 22 of the conductive portion 20 and a resilient portion 42 (cantilever) cantilevered forward from the front edge of the mounting portion 41.

Figure 8:
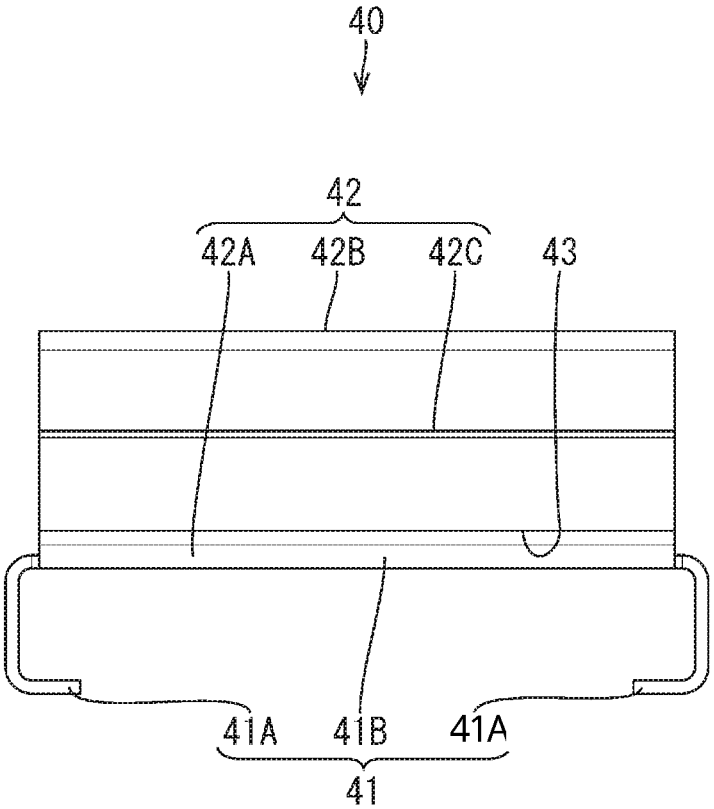
FIG. 8 is a front view of the spring portion.

As shown in FIG. 8, the mounting portion 41 includes a pair of left and right sandwiching portions 41A (side mounts) and a coupling portion 41B (coupler) coupling the pair of left and right sandwiching portions 41A. After extending downward from a side edge of the coupling portion 41B, the sandwiching portion 41A extends inward and is arranged to face the lower surface of the coupling portion 41B.

Figure 3:
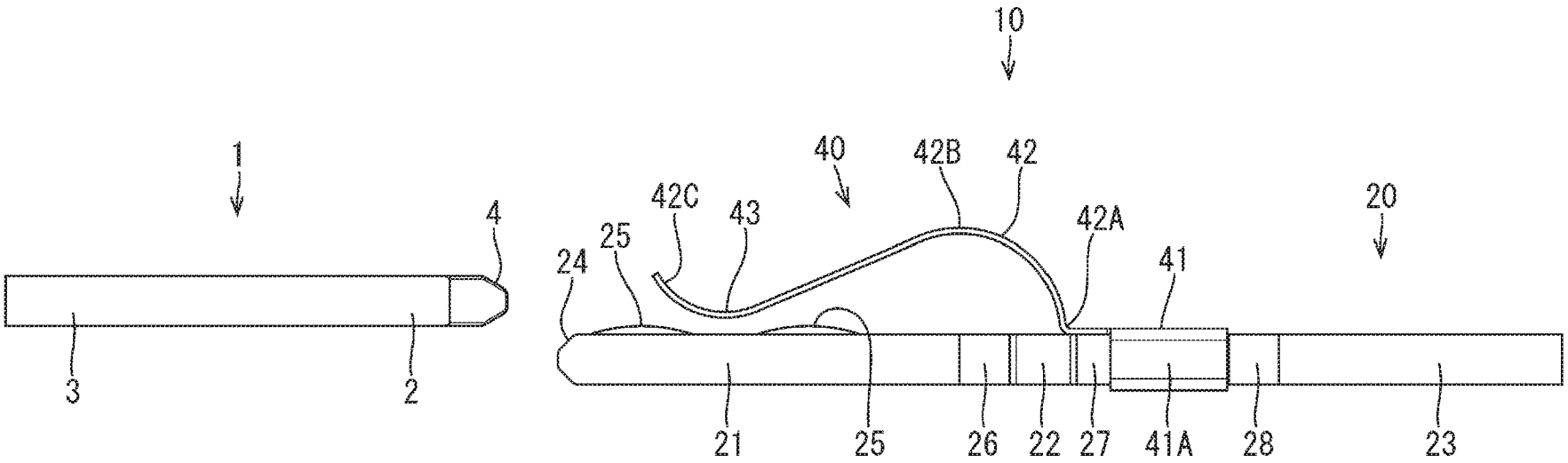
FIG. 3 is a side view showing the state before the terminal and the mating terminal are connected.

As shown in FIG. 3, the resilient portion 42 is shaped to extend forward in an arcuate manner, extend straight forward from a top part 42B to approach the terminal connecting portion 21 and folded somewhat upward at a free end part 42C after rising upward from the front edge of the mounting portion 41 serving as a base end part 42A. With the spring portion 40 mounted on the conductive portion 20, the resilient portion 42 is cantilevered forward from the front edge of the coupling portion 41B and bent to approach the conductive portion 20 after being separated from the conductive portion 20. The resilient portion 42 is entirely resiliently deformed, whereby the free end part 42C is relatively displaceable with respect to the conductive portion 20.

To mount the spring portion 40 on the conductive portion 20, the pair of sandwiching portions 41A of the mounting portion 41 of the spring portion 40 are mounted between the second projecting pieces 27 and the third projecting pieces 28 of the mounted portion 22 of the conductive portion 20 as shown in FIG. 2. Side edges of the mounted portion 22 are surrounded from an upper side by the mounting portion 41 and surrounded from lateral and lower sides by the sandwiching portions 41A, thereby being surrounded on three sides by the mounting portion 41 and the sandwiching portions 41A. In this way, the mounting portion 41 of the spring portion 40 is mounted on the mounted portion 22 of the conductive portion 20. Further, forward movements of the sandwiching portions 41A are suppressed by the rear surfaces 27B of the second projecting pieces 27 and rearward movements thereof are suppressed by the front surfaces 28A of the third projecting pieces 28.

Figure 4:
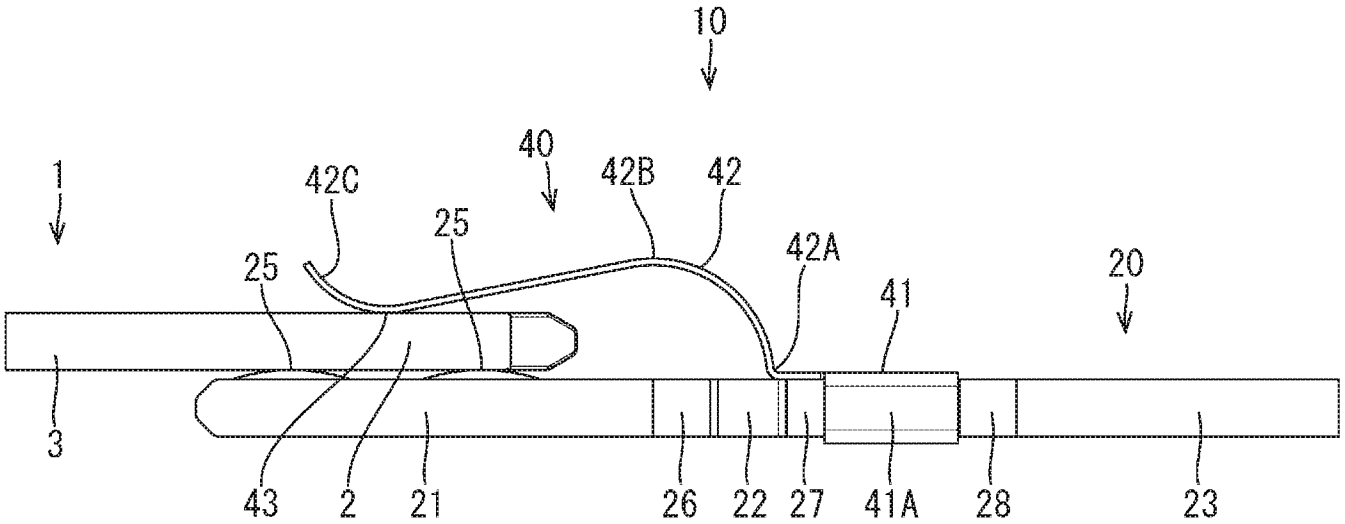
FIG. 4 is a side view showing the state where the terminal and the mating terminal are connected.

As shown in FIG. 3, a height from the contact point portions 25 to a contact pressure applying portion 43 located at a lowermost position of the resilient portion 42 is smaller than a plate thickness of the mating terminal 1 in a state where the spring portion 40 is properly mounted on the conductive portion 20 to complete the terminal 10. Thus, if the mating terminal 1 is inserted between the contact pressure applying portion 43 of the resilient portion 42 and the contact point portions 25 of the terminal connecting portion 21 as shown in FIG. 4, the entire spring portion 40 is deflected and the mating terminal 1 is pressed by the contact pressure applying portion 43, whereby the mating terminal 1 resiliently contacts the contact point portions 25 of the terminal connecting portion 21. In this way, a sufficient contact pressure is generated between the terminal connecting portion 2 of the mating terminal 1 and the terminal connecting portion 21 of the terminal 10 and the mating terminal 1 and the terminal 10 are electrically connected. Since the spring portion 40 is made of the non-conductive material or metal material having a low conductivity, a current from the mating terminal 1 flows into the conductive portion 20.

Figure 5:
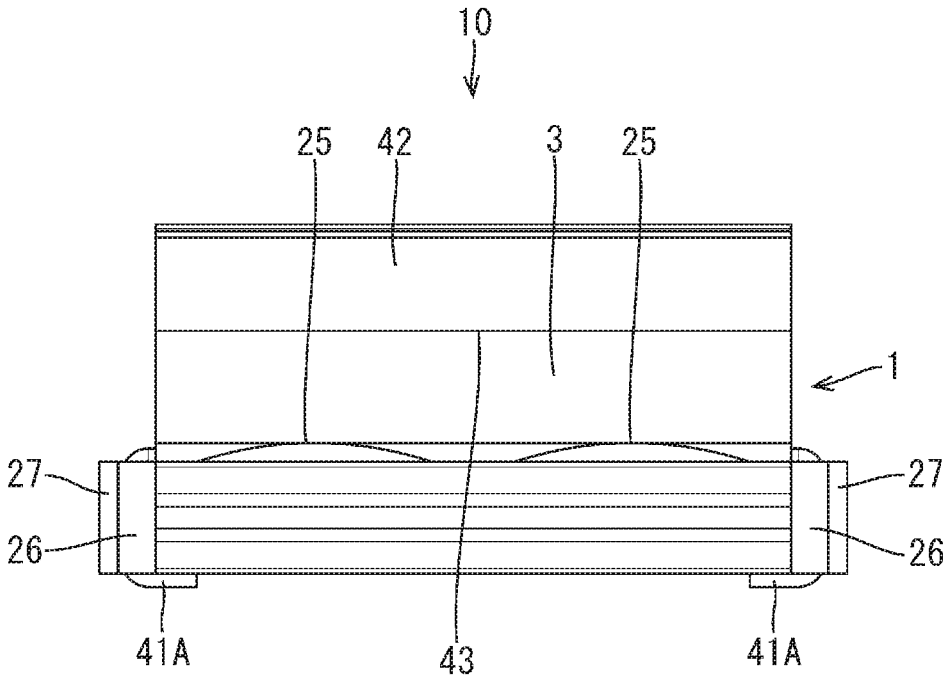
FIG. 5 is a front view showing the state where the terminal and the mating terminal are connected.

Since the terminal connecting portion 2 of the mating terminal 1 simultaneously contacts the plurality of contact point portions 25 of the terminal 10 as shown in FIGS. 4 and 5, contact resistance generated at each contact point portion 25 can be reduced and a larger current can be dealt with. Further, if the plate thickness of the mating terminal 1 increases as a current becomes larger, the plate thickness of the conductive portion 20 of the terminal 10 is expected to also increase. In this case, since it is sufficient to increase only the plate thickness of the conductive portion 20, the formation of the terminal 10 does not become difficult. Specifically, the conductive portion 20 can be formed only by stamping without requiring bending and the like.

Further, in a terminal in which a spring portion and a conductive portion are integrally formed, a plate thickness of the spring portion increases as that of the conductive portion increases. Thus, the rigidity of the spring portion increases to lose a spring property. In that respect, since the spring portion 40 is configured separately from the conductive portion 20 in the terminal 10 of this embodiment, the plate thickness of the spring portion 40 can be kept constant and the spring property is not lost even if the plate thickness of the conductive portion increases.

As described above, in this embodiment, the spring portion 40 only has to have a spring property as a required performance and needs not have conductivity. Thus, the spring portion 40 can be made of an inexpensive metal material and material cost can be reduced. Further, even if the plate thickness of the conductive portion 20 increases as a current becomes larger, bending and the like are not necessary in forming the conductive portion 20. Thus, the formation of the conductive portion 20 does not become difficult. Furthermore, since the conductive portion 20 is not in the form of a rectangular tube, but in the form of a plate, the conductive portion 20 is only enlarged by an increase of the plate thickness. In addition, since the spring portion 40 and the conductive portion 20 are separate, even if the plate thickness of the conductive portion 20 increases, that does not affect the spring property of the spring portion 40.

The mounting portion 41 may include the pair of sandwiching portions 41A for sandwiching both side edge parts of the conductive portion 20 and the coupling portion 41B coupling the pair of sandwiching portions 41A.

According to this configuration, the spring portion 40 can be mounted on the conductive portion 20 by sandwiching the both side edge parts of the conductive portion 20 by the pair of sandwiching portions 41A.

The resilient portion 42 may be bent to approach the conductive portion 20 after being cantilevered forward from the front edge of the coupling portion 41B and separated from the conductive portion 20.

According to this configuration, the spring property of the resilient portion 20 can be maintained satisfactory as compared to the case where the resilient portion 42 is in the form of a flat plate.

Second Embodiment

Figure 9:
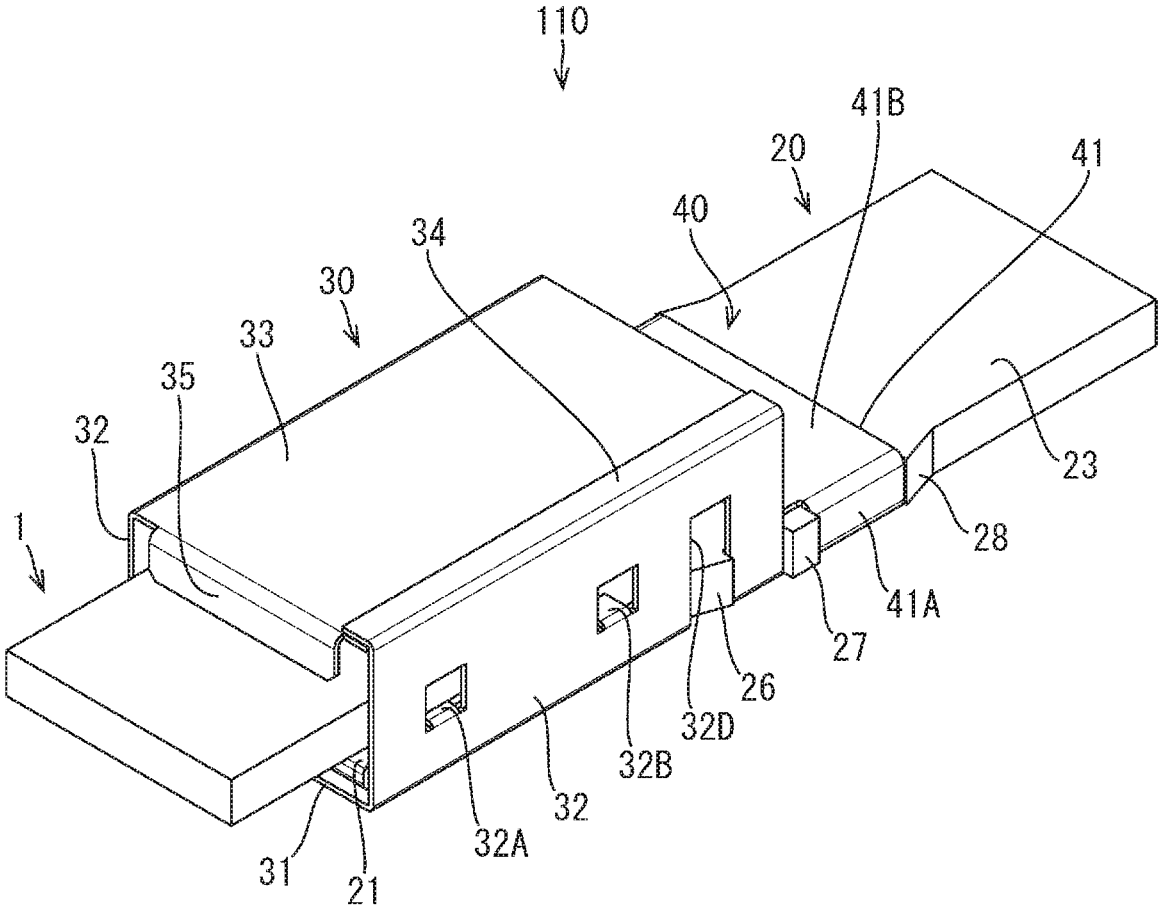
FIG. 9 is a perspective view showing a state where a terminal in a second embodiment and a mating terminal are connected.
Figure 10:
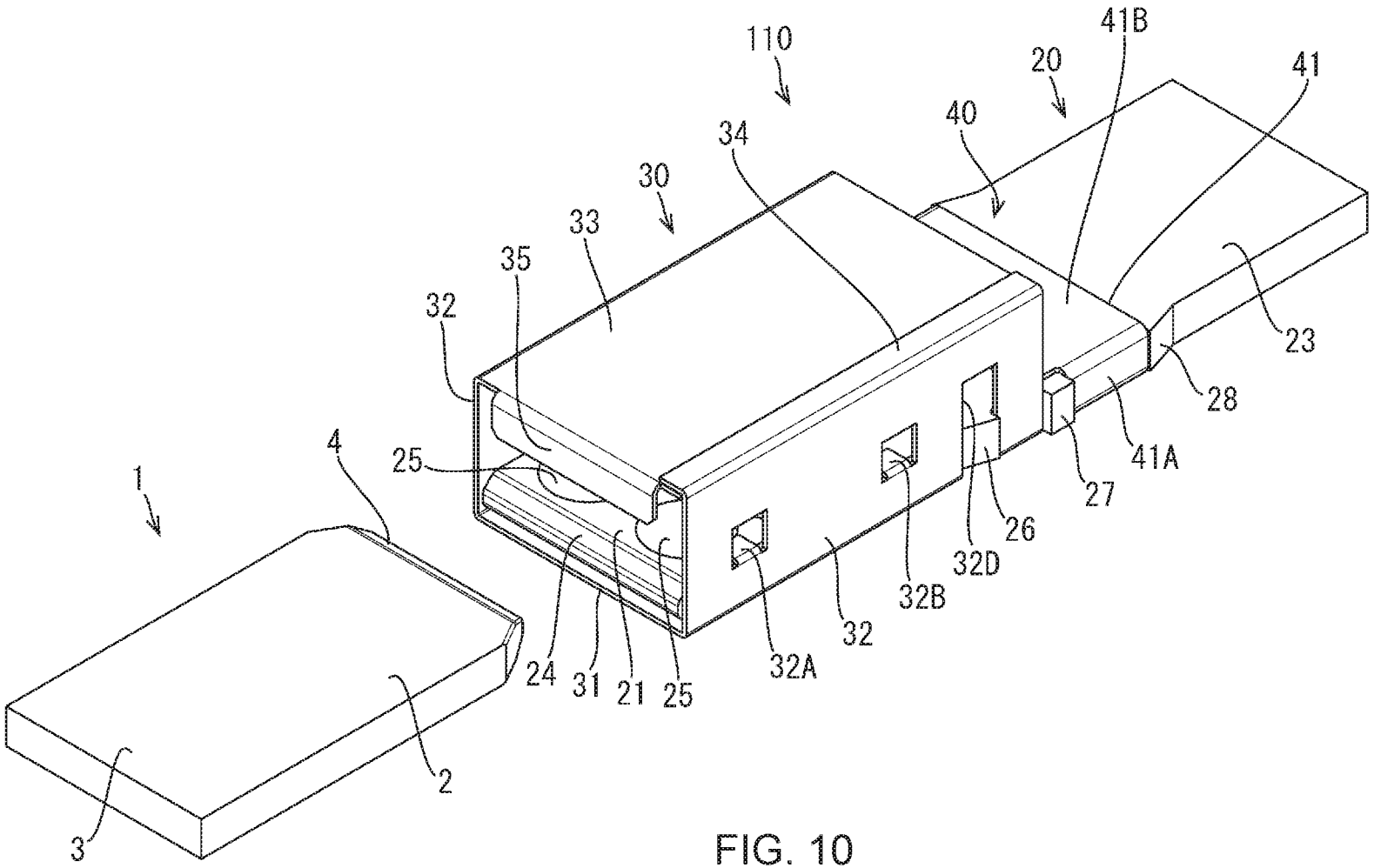
FIG. 10 is a perspective view showing a state before the terminal and the mating terminal are connected.
Figure 11:
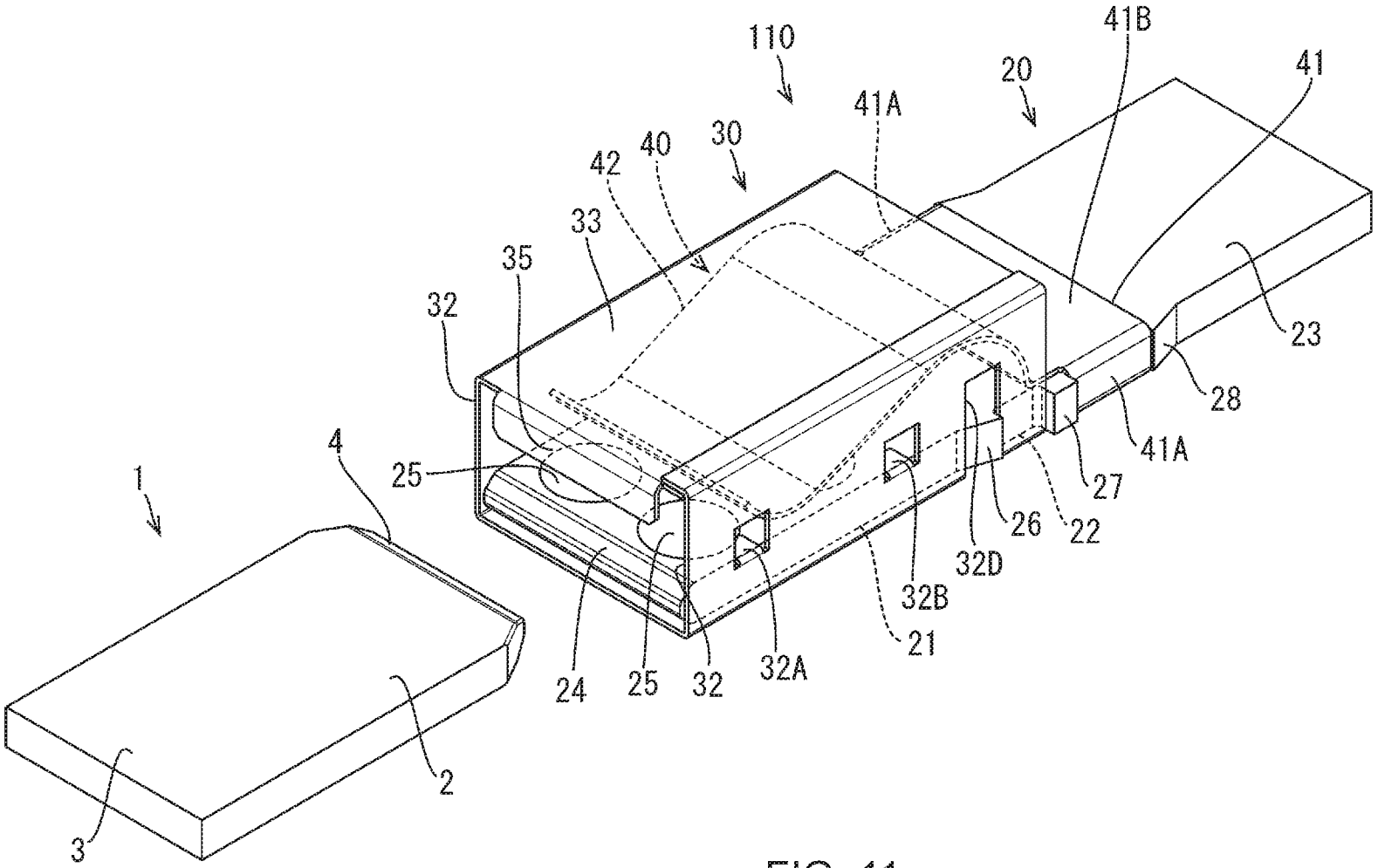
FIG. 11 is a perspective view with an internal structure of the terminal in FIG. 10 shown by broken line.
Figure 12:
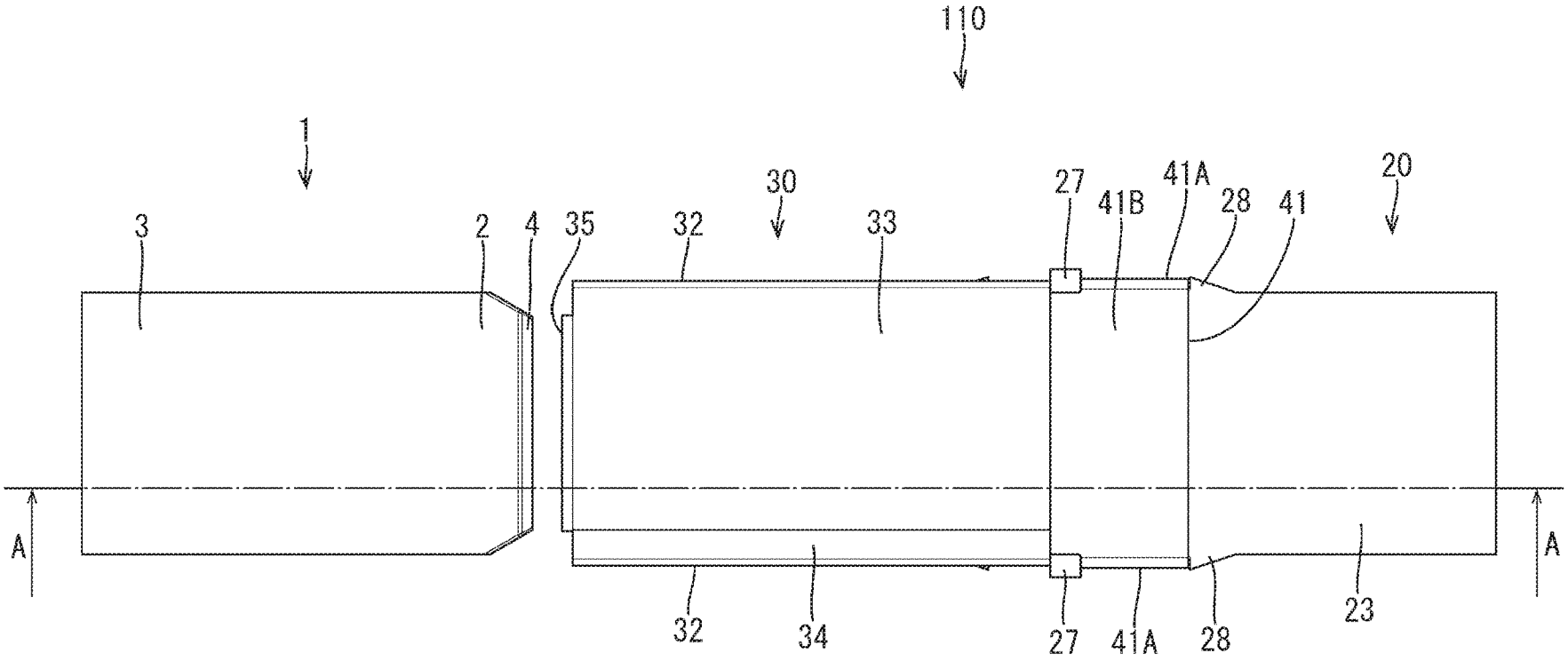
FIG. 12 is a plan view showing the state before the terminal and the mating terminal are connected.

Next, a second embodiment is described with reference to FIGS. 9 to 18. A terminal 110 of this embodiment is formed by adding a box portion 30 (box) to the terminal 10 of the first embodiment as shown in FIGS. 9 to 11. The box portion 30 is made of the same metal material as a spring portion 40. The box portion 30 is in the form of a rectangular tube and functions to prevent a resilient portion 42 from being damaged by an inner wall of a cavity by covering and protecting the resilient portion 42 of the spring portion 40 when the terminal 110 is inserted into the cavity of an unillustrated housing.

Figure 18:
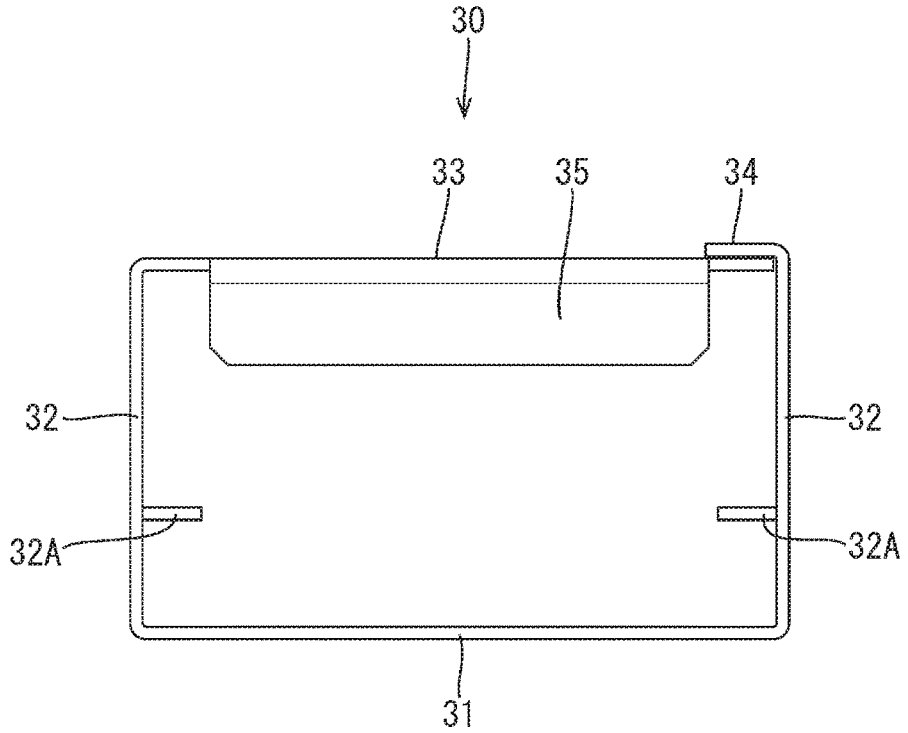
FIG. 18 is a front view of the box portion.
Figure 19:
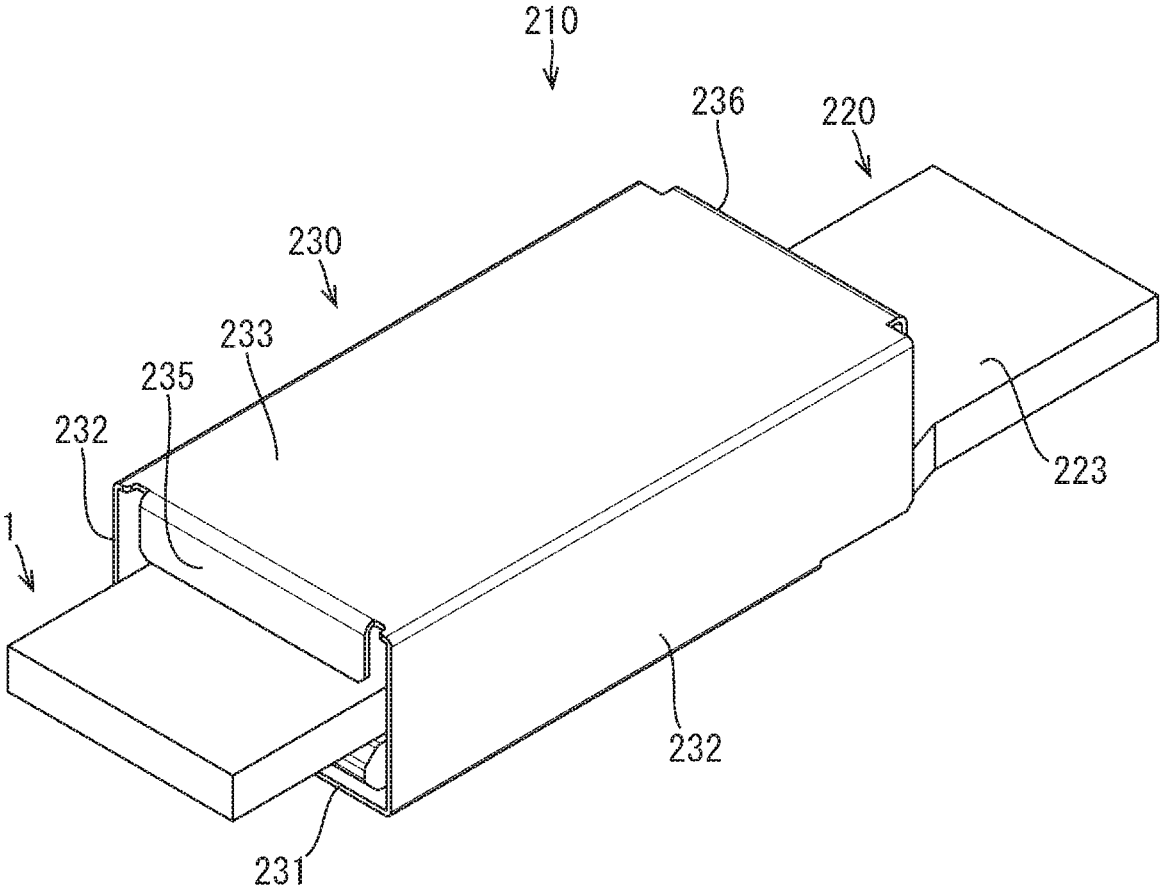
FIG. 19 is a perspective view showing a state where a terminal in a third embodiment and a mating terminal are connected.
Figure 20:
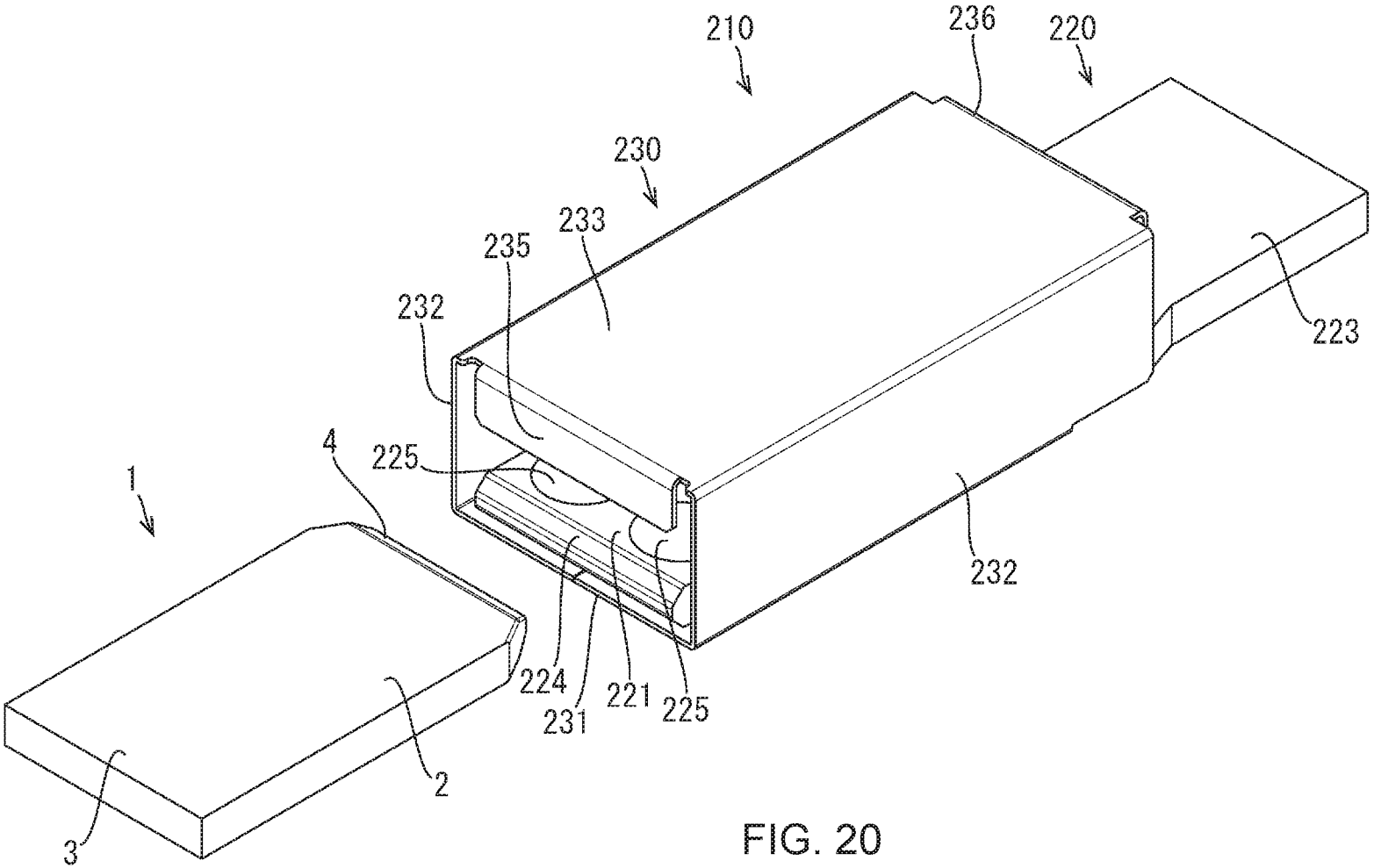
FIG. 20 is a perspective view showing a state before the terminal and the mating terminal are connected.

As shown in FIG. 18, the box portion 30 includes a bottom wall 31, a pair of left and right side walls 32 rising from both side edges of the bottom wall 31 while facing each other, a ceiling wall 33 extending from the upper edge of the left side wall 32 toward the upper edge of the right side wall 32 and an opening preventing wall 34 extending leftward from the upper edge of the right side wall 32 along the upper surface of the ceiling wall 33. The upward opening of a right end part of the ceiling wall 33 is prevented by the opening preventing wall 34.

Figure 13:
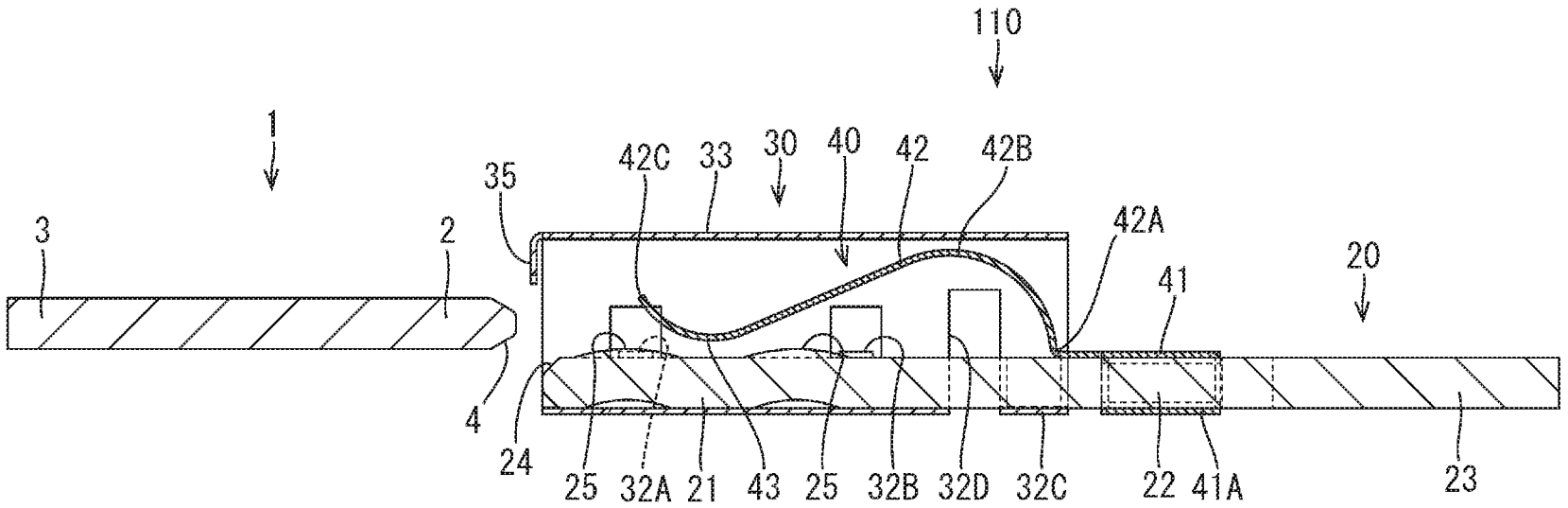
FIG. 13 is a section along A-A in FIG. 12.
Figure 14:
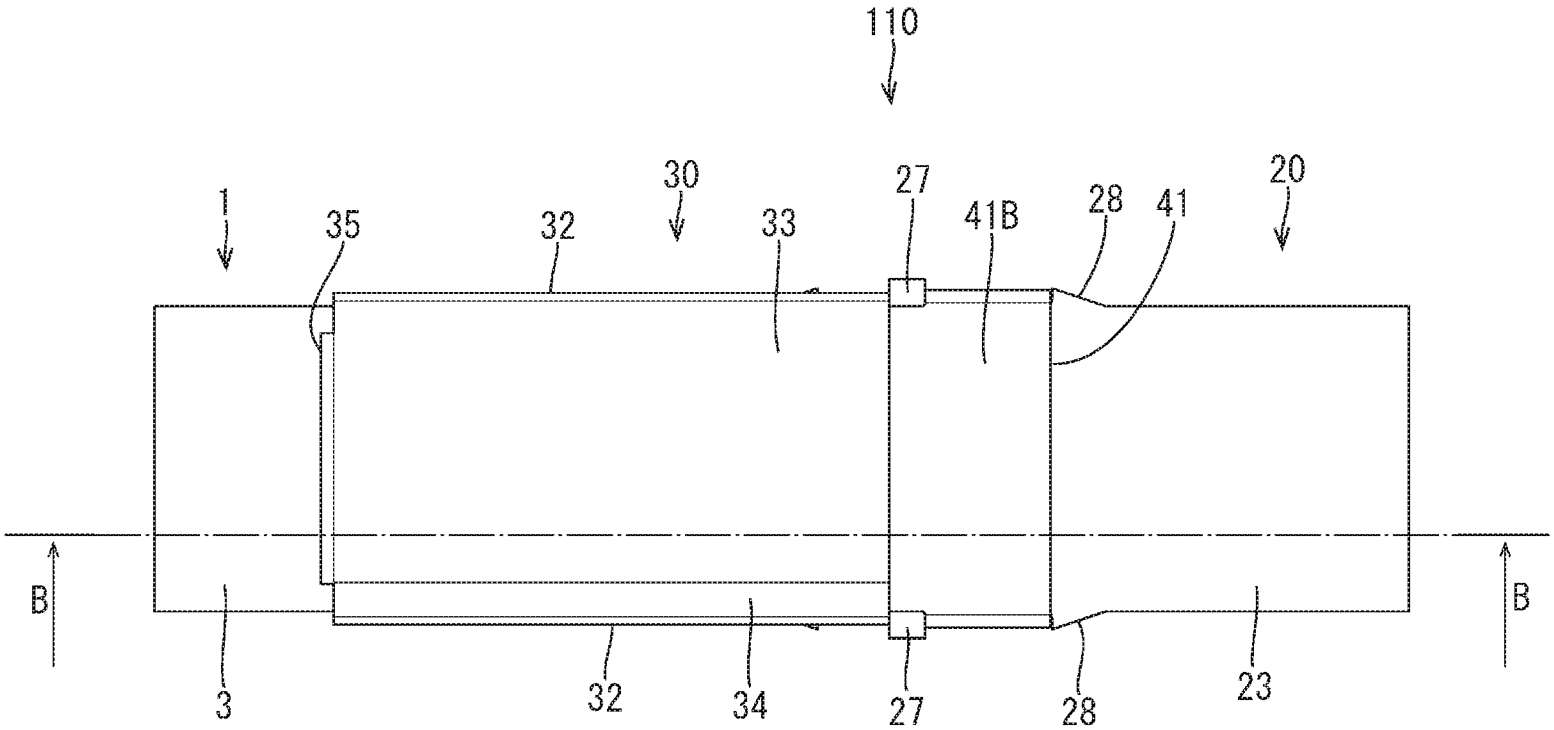
FIG. 14 is a plan view showing the state where the terminal and the mating terminal are connected.
Figure 17:
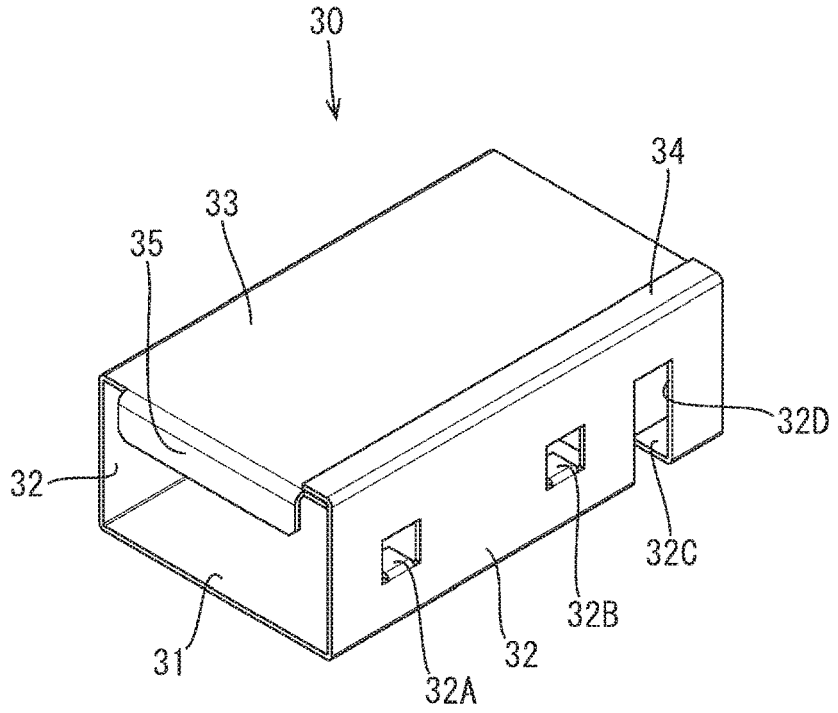
FIG. 17 is a perspective view of a box portion.

As shown in FIG. 17, an erroneous insertion preventing wall 35 is provided on the front edge of the ceiling wall 33. The erroneous insertion preventing wall 35 extends downward from the front edge of the ceiling wall 33. As shown in FIG. 13, the lower end position of the erroneous insertion preventing wall 35 is substantially at the same height as the tip position of a free end part 42C of the resilient portion 42. In this way, a mating terminal 1 is prevented from erroneously entering between the resilient portion 42 and the ceiling wall 33.

The side wall 32 of the box portion 30 includes a first upper pressing piece 32A disposed on a front side, a second upper pressing piece 32B disposed behind the first upper pressing piece 32A and a lower pressing piece 32C disposed behind the second upper pressing piece 32B. The first and second upper pressing pieces 32A, 32B are formed by cutting and raising parts of the side wall 32, and cut-and-raised holes are formed above the respective pressing pieces 32A, 32B. Further, the lower pressing piece 32C is formed at the same height position as the bottom wall 31, and a cutout 32D for allowing a first projecting piece 26 to escape when the box portion 30 is assembled with the conductive portion 20 is formed in front of the lower pressing piece 32C.

The cutout 32D is located below the resilient portion 42 and disposed at such a position that the resilient portion 42 is not laterally exposed. If the first projecting piece 26 is fit into the cutout 32D, the lower pressing piece 32C is mounted between the first projecting piece 26 and a second projecting piece 27. A forward movement of the lower pressing piece 32C is suppressed by a rear surface 26B of the first projecting piece 26, and a rearward movement thereof is suppressed by a front surface 27A of the second projecting piece 27.

The first and second upper pressing pieces 32A, 32B are in contact with the upper surface of a side edge of a terminal connecting portion 21 and the lower pressing piece 32C is in contact with the lower surface of the side edge of the terminal connecting portion 21. In this way, the upper surface of the bottom wall 31 of the box portion 30 is held in contact with the lower surface of the conductive portion 20 and a vertical movement of the box portion 30 with respect to the conductive portion 20 is suppressed.

Figure 15:
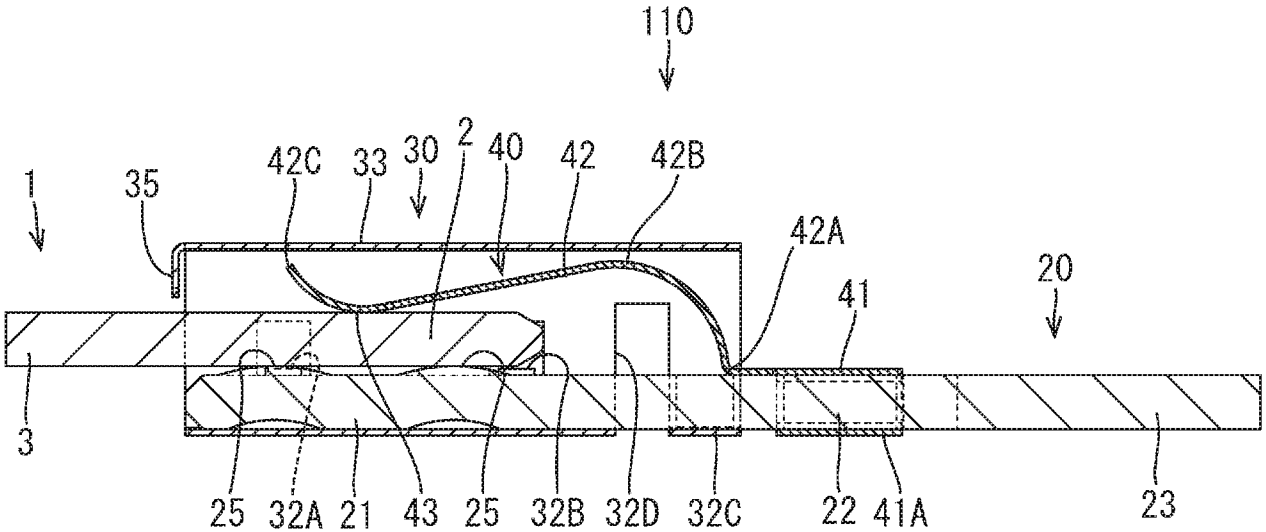
FIG. 15 is a section along B-B in FIG. 14.
Figure 16:
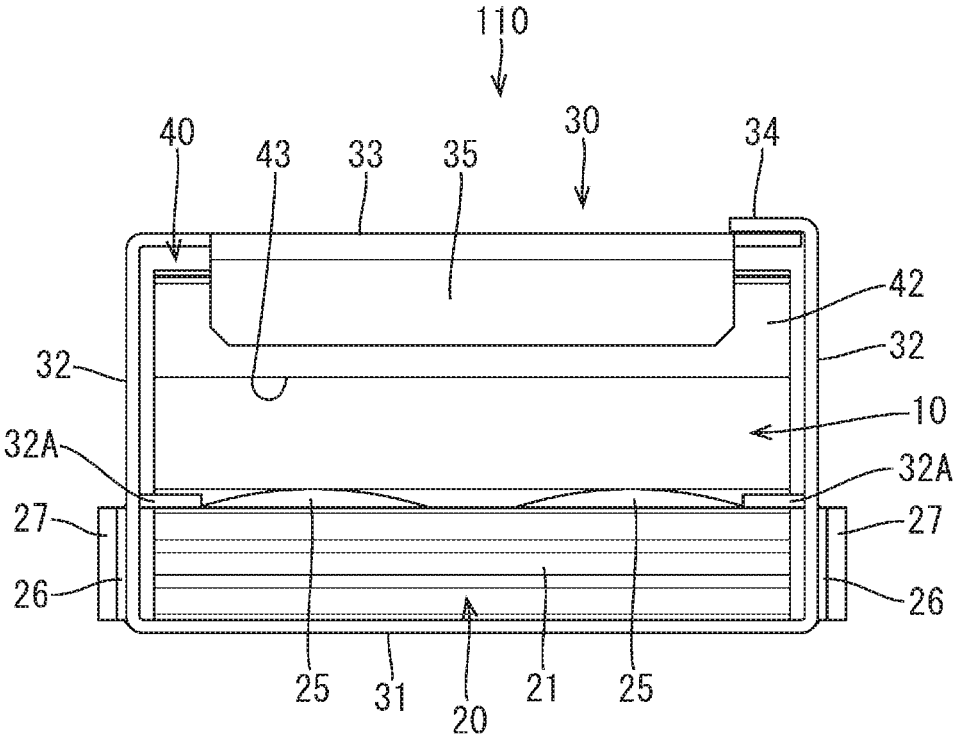
FIG. 16 is a front view showing the state where the terminal and the mating terminal are connected.

If the mating terminal 1 is connected to the terminal 110 as shown in FIG. 15, a contact pressure applying portion 43 rides on the upper surface of a terminal connecting portion 2 and the entire resilient portion 42 is deflected, but a top part 42B and the free end part 42C are not in contact with the ceiling wall 33. The mating terminal 1 is resiliently held in contact with contact point portions 25 by being pressed by the contact pressure applying portion 43 of the resilient portion 42.

Since the box portion 30 for accommodating the spring portion 40 inside is provided in this embodiment as described above, the spring portion 40 can be protected by the box portion 30.

Third Embodiment

Figure 31:
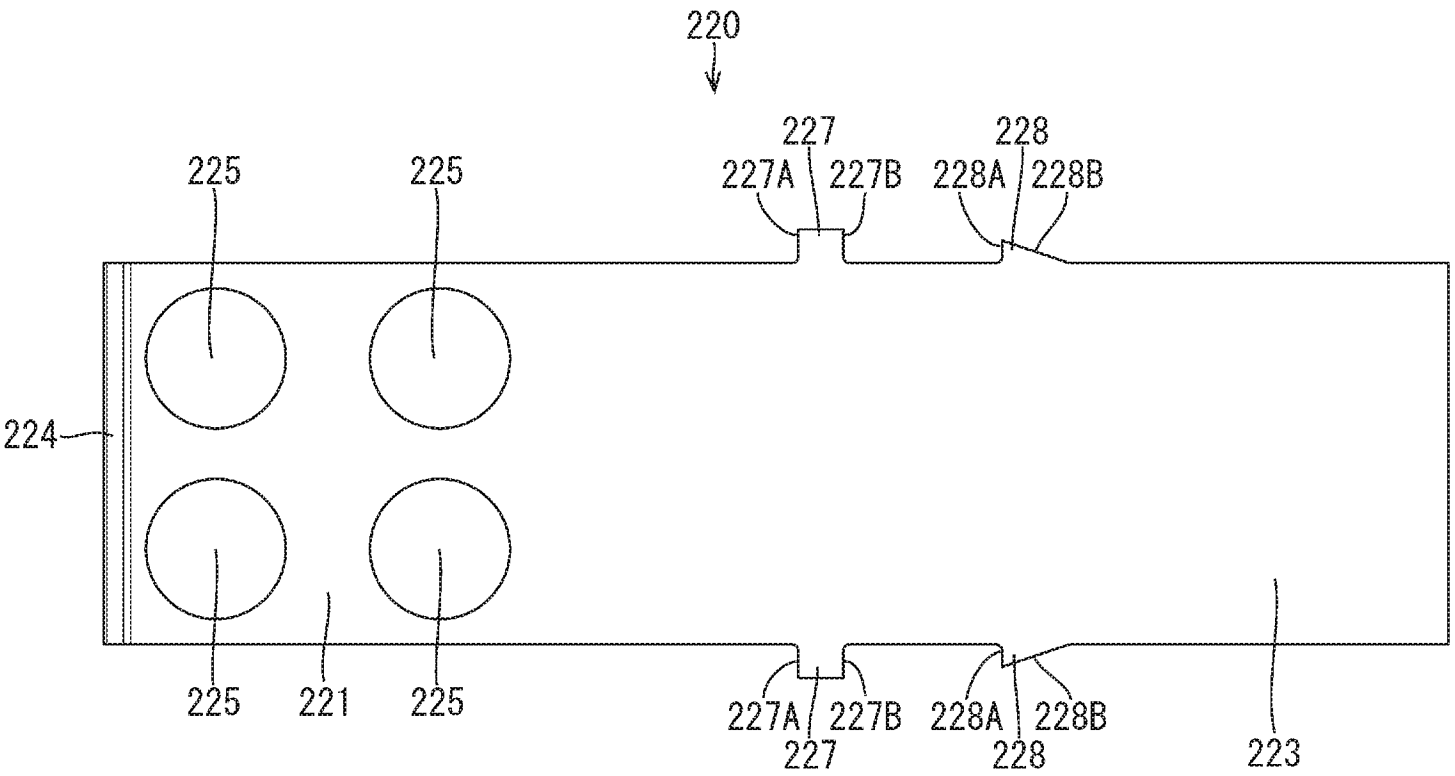
FIG. 31 is a plan view of a conductive portion.

Next, a third embodiment is described with reference to FIGS. 19 to 31. A terminal 210 of this embodiment differs from the second embodiment in that the box portion 30 and the spring portion 40 in the second embodiment are integrally configured. Further, as shown in FIG. 31, a conductive portion 220 of this embodiment differs from the second embodiment in that the pair of first projecting pieces 26 are omitted from the conductive portion 20 of the first embodiment. Note that the same components as those of the first embodiment are denoted by reference signs obtained by adding 200 to numerical parts of the reference signs of the first embodiment and not repeatedly described.

Figure 22:
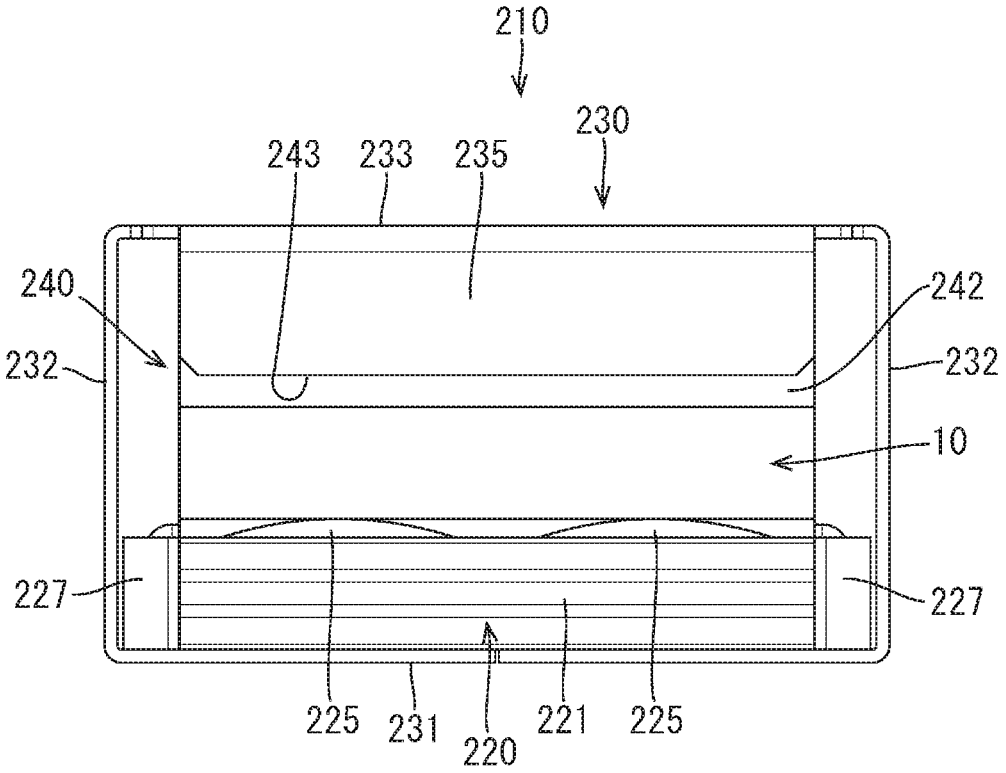
FIG. 22 is a front view showing the state where the terminal and the mating terminal are connected.
Figure 23:
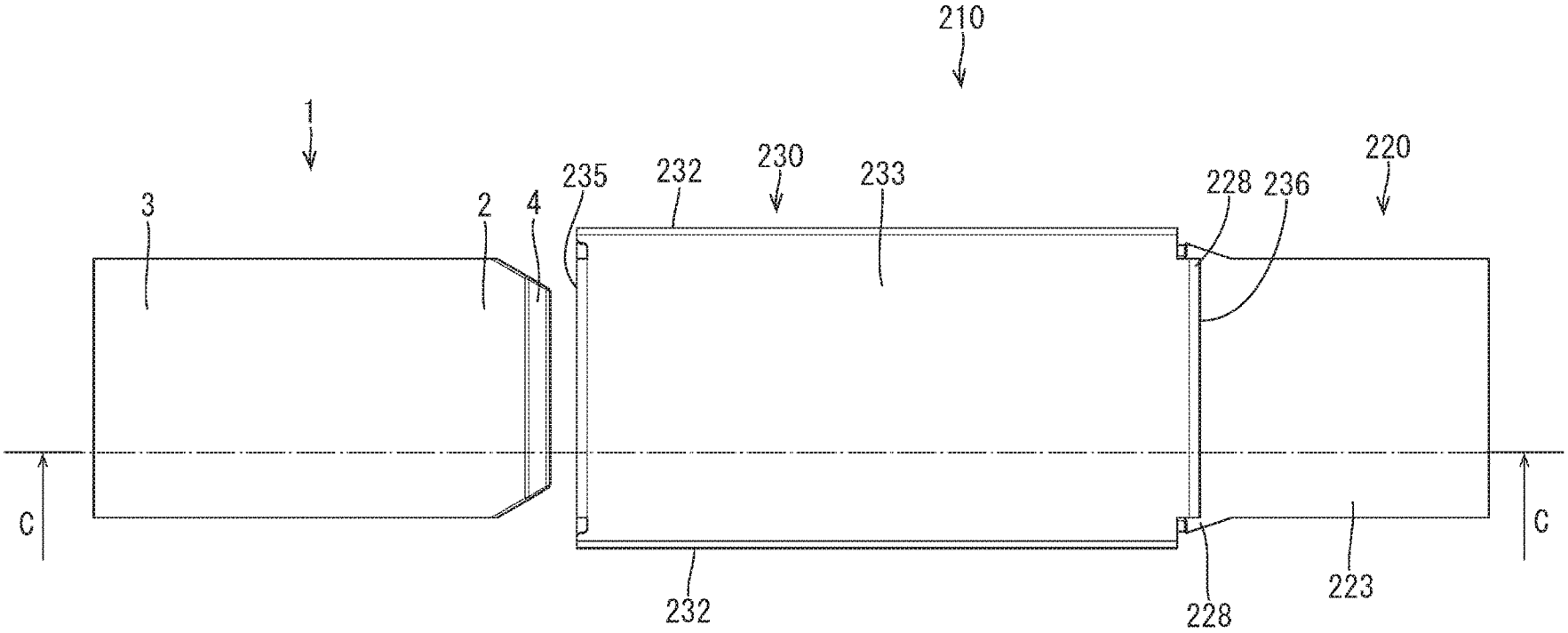
FIG. 23 is a plan view showing the state before the terminal and the mating terminal are connected.

A box portion 230 of this embodiment includes a bottom wall 231, a pair of left and right side walls 232 and a ceiling wall 233, but does not include a member equivalent to the opening preventing wall 34 as shown in FIG. 22. Further, the bottom wall 231 is divided into two at a lateral center. Further, the side wall 232 does not include members equivalent to the upper pressing pieces 32A, 32B and a member equivalent to the lower pressing piece 32C. Thus, cut-and-raised holes are not formed in the side wall 232 and the box portion 230 is higher in rigidity than the box portion 30 of the second embodiment.

Figure 24:
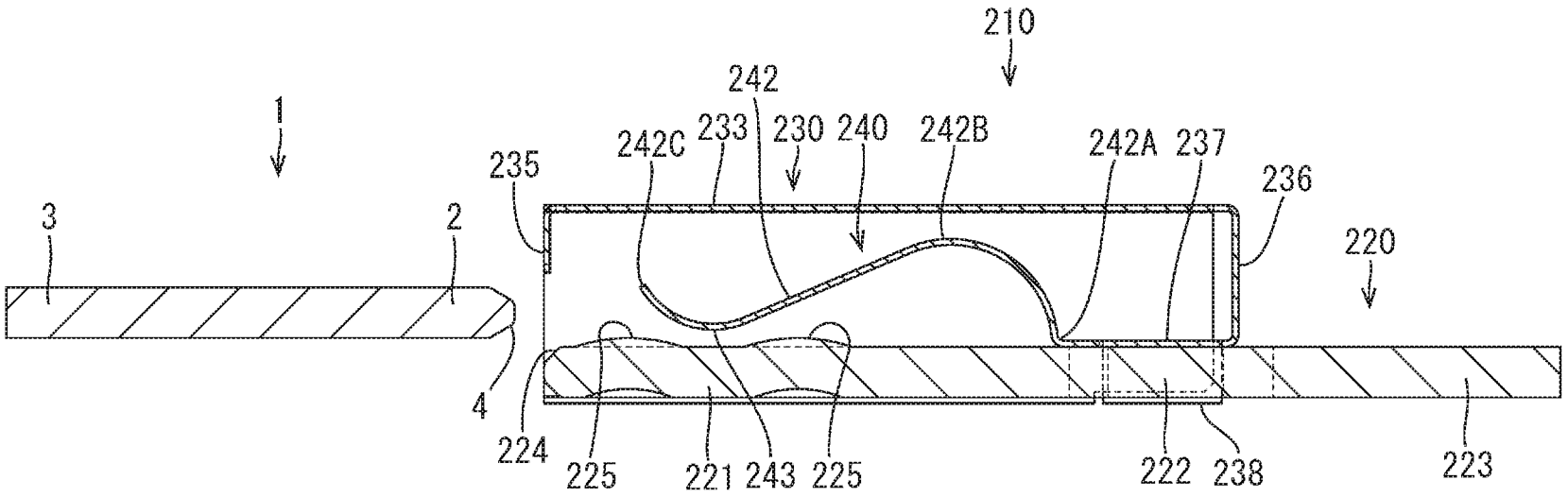
FIG. 24 is a section along C-C in FIG. 23.
Figure 25:
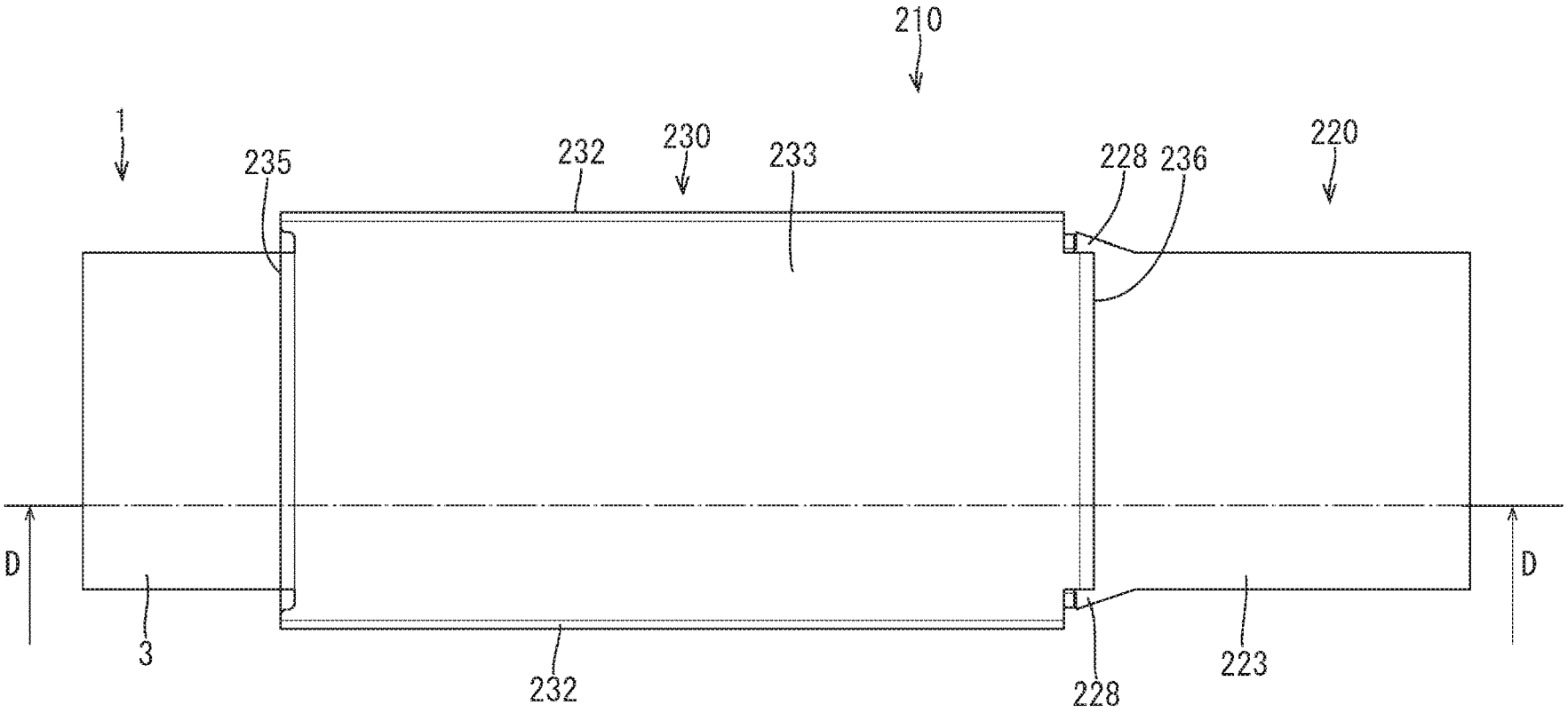
FIG. 25 is a plan view showing the state where the terminal and the mating terminal are connected.

As shown in FIG. 24, an erroneous insertion preventing wall 235 is provided on the front edge of the ceiling wall 232. On the other hand, a rear wall 236 extending downward is provided on the rear edge of the ceiling wall 232, and a horizontal wall 237 extending forward is provided on the lower edge of the rear wall 236. A resilient portion 242 is provided which is cantilevered forward with the front end of this horizontal wall 237 serving as a base end part 242A.

The resilient portion 242 is shaped to extend forward in an arcuate manner, extend straight forward from a top part 242B to approach a terminal connecting portion 221 and folded somewhat upward at a free end part 242C after rising upward from the base end part 242A. A spring portion 240 is bent to approach a conductive portion 220 after being separated from the conductive portion 220. The resilient portion 242 is entirely resiliently deformed, whereby the free end part 242C is relatively displaceable with respect to the conductive portion 220.

Figure 21:
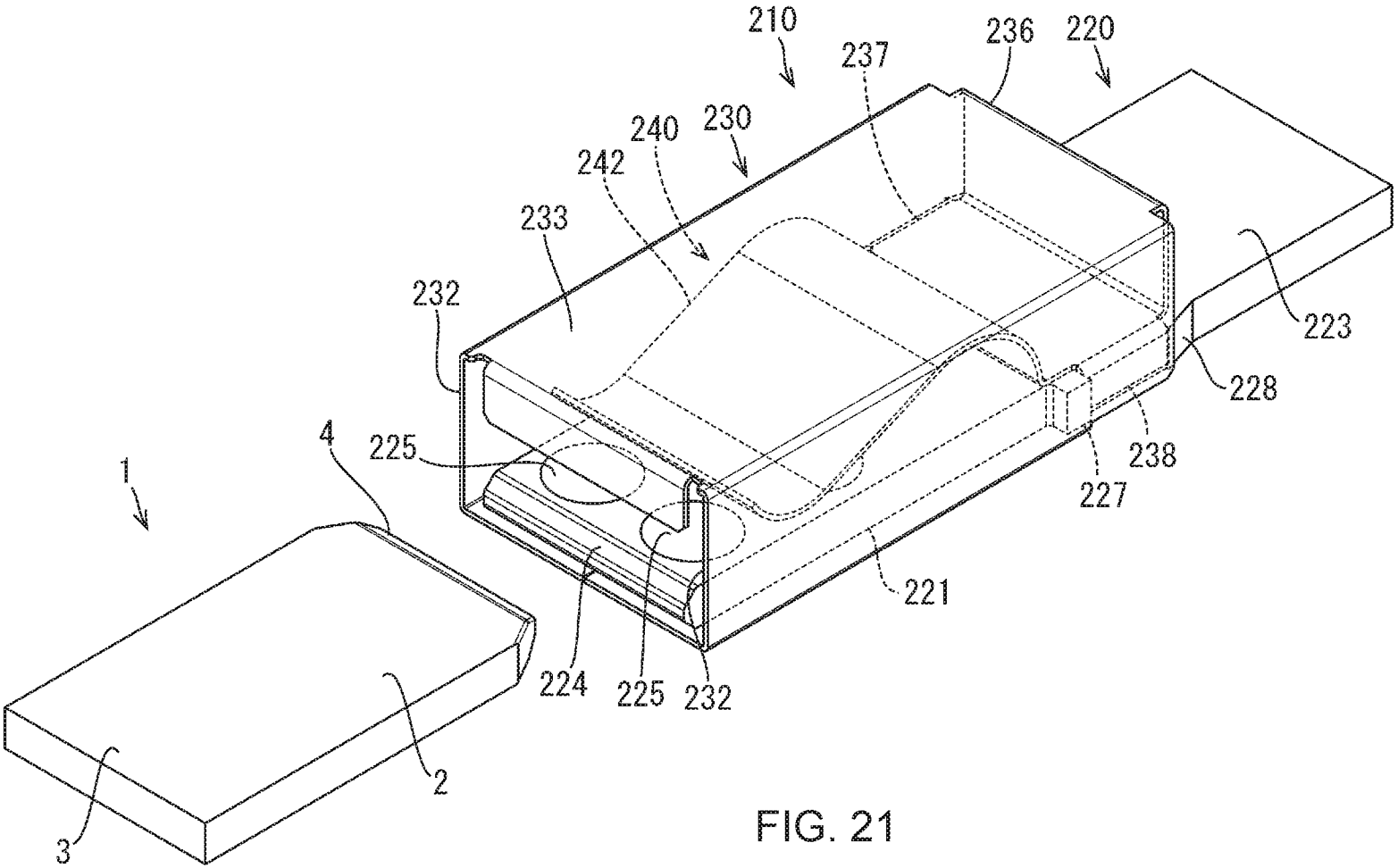
FIG. 21 is a perspective view with an internal structure of the terminal in FIG. 20 shown by broken line.

As shown in FIG. 21, a pair of left and right sandwiching portions 238 are provided on both side edges of the horizontal wall 237. After extending downward from one side edge of the horizontal wall 237, the sandwiching portion 238 extends inward toward the other side surface along the lower surface of a mounted portion 222.

To mount the box portion 250 on the conductive portion 220, the sandwiching portions 238 of the horizontal wall 237 are mounted between second projecting pieces 272 and third projecting pieces 228 of the mounted portion 222 as shown in FIG. 21. Side edges of the mounted portion 222 are surrounded from an upper side by the horizontal wall 237 and surrounded from lateral and lower sides by the sandwiching portions 238, thereby being surrounded on three sides by the horizontal wall 237 and the sandwiching portions 238. In this way, the box portion 250 is mounted on the mounted portion 222 of the conductive portion 220. Further, forward movements of the sandwiching portions 238 are suppressed by rear surfaces 227B of the second projecting pieces 227 and rearward movements thereof are suppressed by front surfaces 228A of the third projecting pieces 228.

Figure 26:
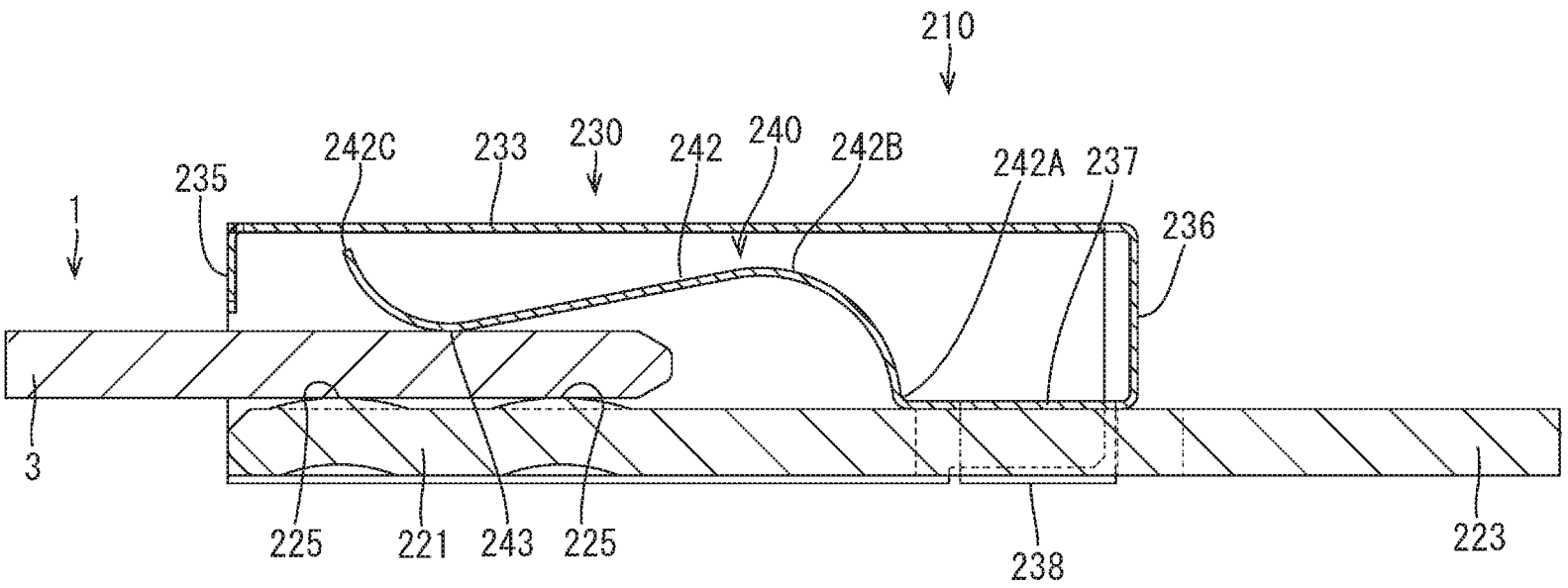
FIG. 26 is a section along D-D in FIG. 25.
Figure 27:
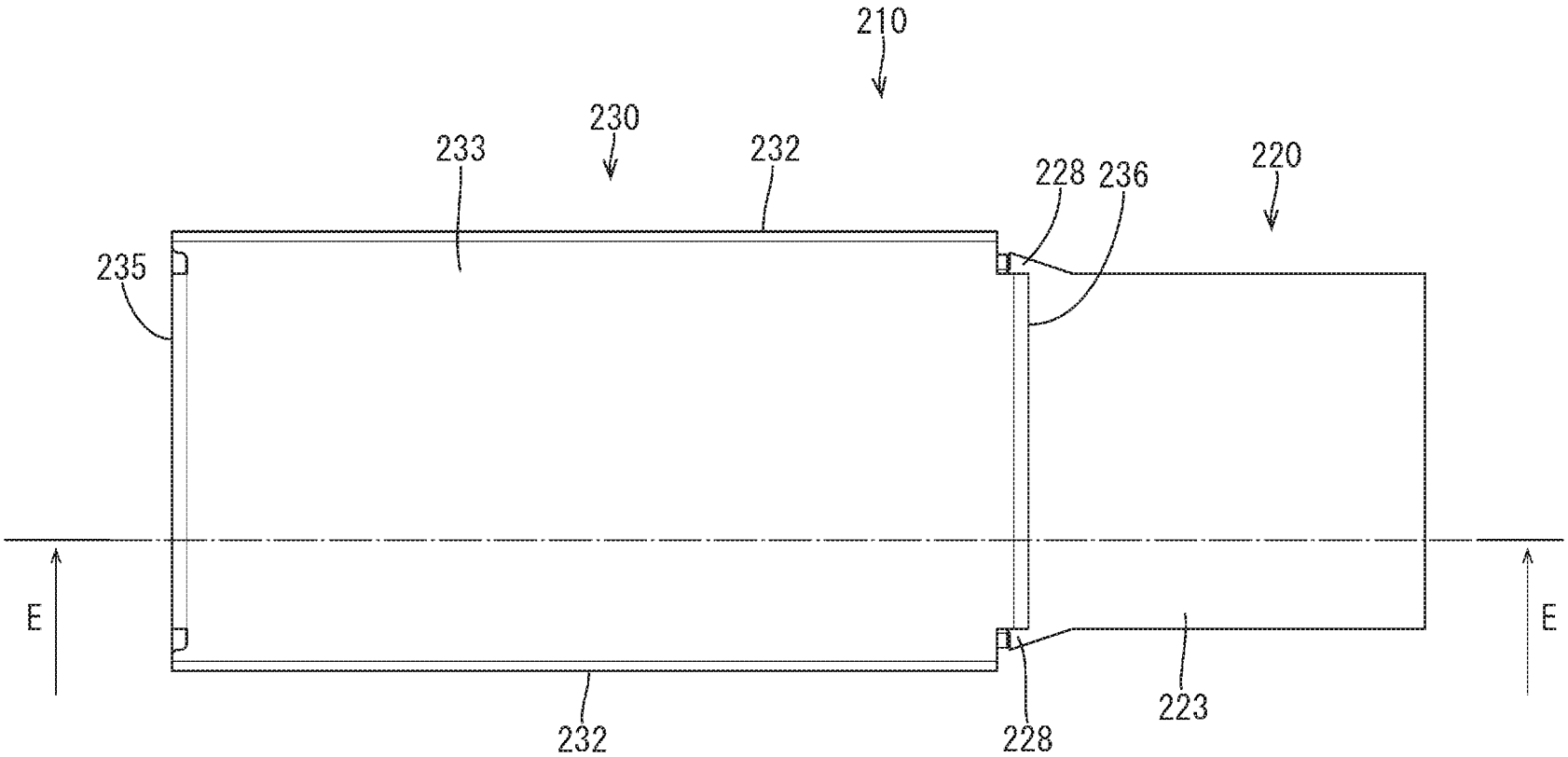
FIG. 27 is a plan view of the terminal.
Figure 28:
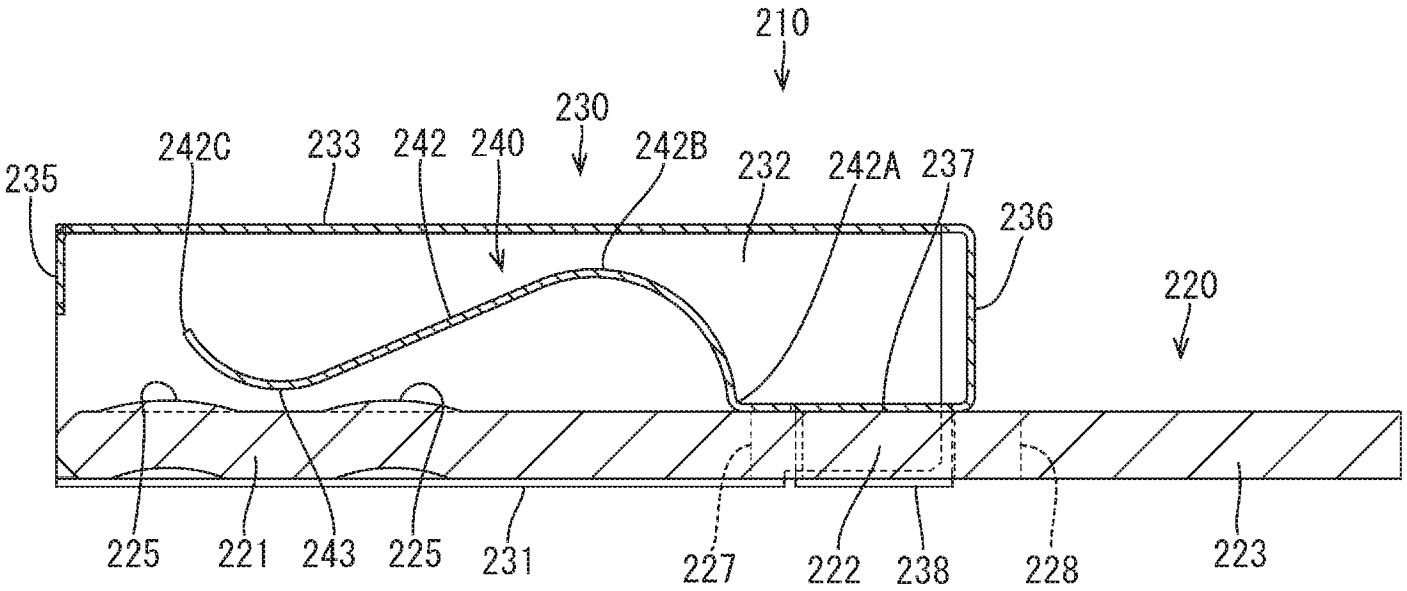
FIG. 28 is a section along E-E in FIG. 27.
Figure 29:
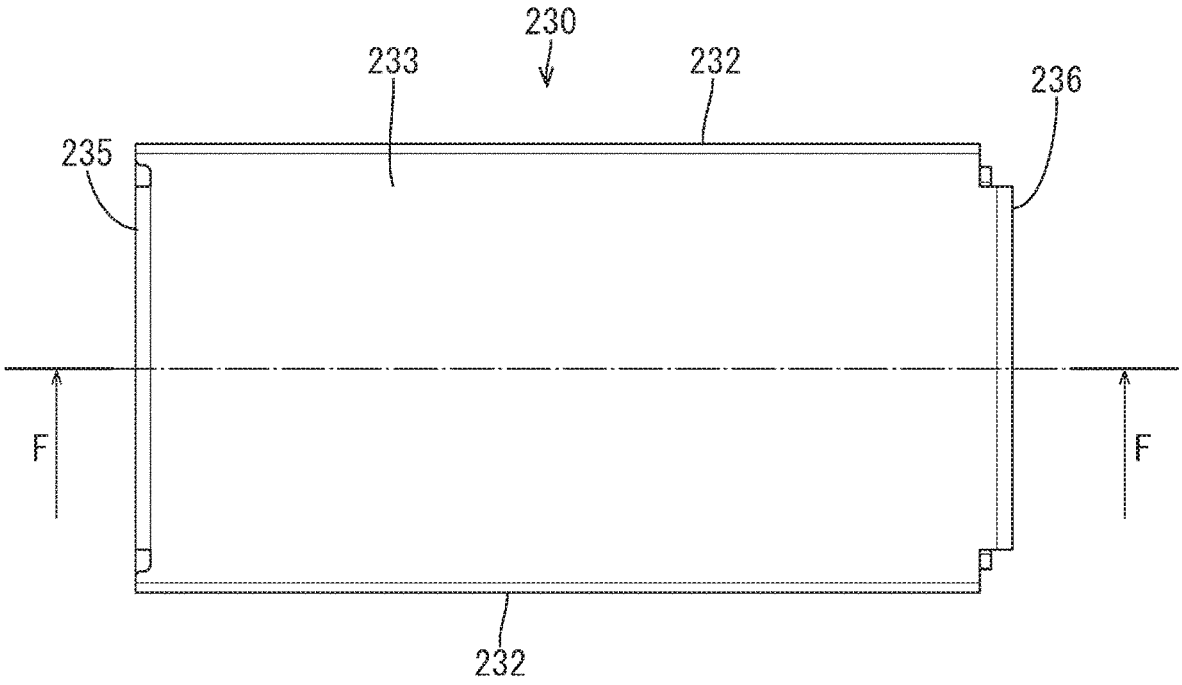
FIG. 29 is a plan view of a box portion.
Figure 30:
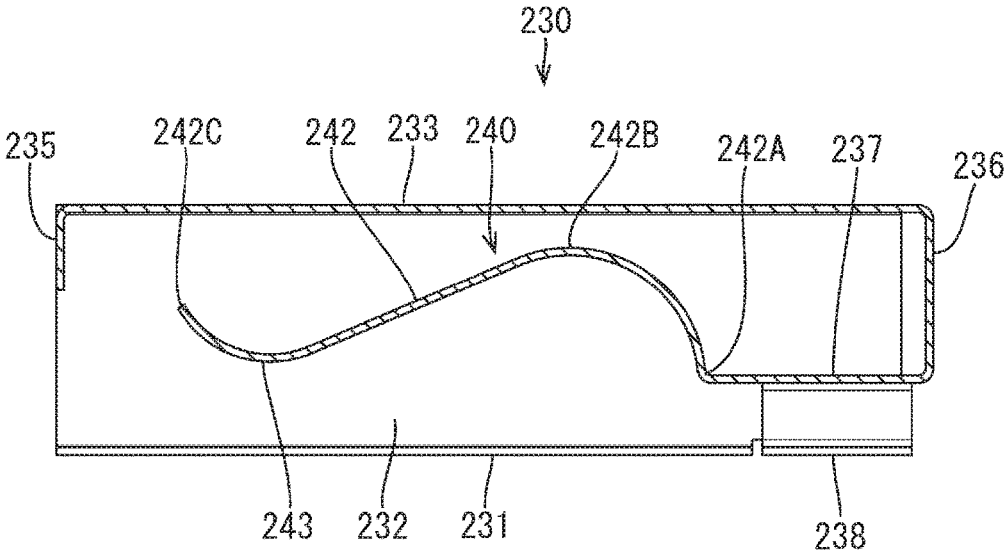
FIG. 30 is a section along F-F in FIG. 29.

If a mating terminal 1 is connected to the terminal 210 as shown in FIG. 26, a contact pressure applying portion 243 rides on the upper surface of a terminal connecting portion 2 and the entire resilient portion 242 is deflected, but the top part 242B and the free end part 242C are not in contact with the ceiling wall 233. The mating terminal 1 is resiliently held in contact with contact point portions 225 by being pressed by the contact pressure applying portion 243 of the resilient portion 242.

Since the spring portion 240 is formed integrally to the box portion 250 in this embodiment as described above, it is sufficient to mount the box portion 250 on the conductive portion 220 and it is not necessary to separately mount a spring portion on a conductive portion.

OTHER EMBODIMENTS

The technique disclosed in this specification is not limited to the above described and illustrated embodiments. For example, the following various modes are also included.

(1) Although the mounting portion includes the pair of sandwiching portions and the coupling portion in the above embodiments, a mounting portion may be mounted on a conductive portion by welding or by bolting.

(2) Although the resilient portion extends forward from the front edge of the coupling portion in the above embodiments, a resilient portion may extend forward from the rear edge of a coupling portion.

(3) Although the box portion and the spring portion are made of the same metal material in the above embodiments, a box portion and a spring portion may be made of different metal materials.

The invention claimed is:

1. A terminal, comprising:

a conductor made of a metal material, the conductor being in a form of a plate and being provided with a contact point to be conductively connected to a mating terminal; and a spring formed to be thinner than the conductor and resiliently deformable and provided with a mount mounted on the conductor and a cantilever cantilevered from the mount and relatively displaceable with respect to the conductor, the mating terminal being resiliently held in contact with the contact point by being pressed by the cantilever, a tip of the mating terminal being disposed between the mount and the contact point, and the conductor being surrounded from an upper side, a lateral side and a lower side by the mount.

2. The terminal of claim 1, comprising a box for accommodating the spring inside.

3. The terminal of claim 2, wherein the spring is integrally formed to the box.

4. A terminal, comprising:

a conductor made of a metal material, the conductor being in a form of a plate and being provided with a contact point to be conductively connected to a mating terminal; and a spring formed to be thinner than the conductor and resiliently deformable and provided with a mount mounted on the conductor and a cantilever cantilevered from the mount and relatively displaceable with respect to the conductor, the mating terminal being resiliently held in contact with the contact point by being pressed by the cantilever, the mount including a pair of side mounts for sandwiching both side edge parts of the conductor and a coupler coupling the pair of side mounts, and the conductor being surrounded from an upper side by the mount and surrounded from lateral and lower sides by the pair of side mounts.

5. The terminal of claim 4, wherein the cantilever is cantilevered forward from a front edge of the coupler and bent to approach the conductor after being separated from the conductor.

* * * * *